US007454157B2

(12) United States Patent
Yamada et al.

(10) Patent No.: US 7,454,157 B2
(45) Date of Patent: Nov. 18, 2008

(54) IMAGE FORMING DEVICE AND UNIT POSITION ADJUSTMENT METHOD

(75) Inventors: Masahiko Yamada, Tokyo (JP); Takayuki Andoh, Kanagawa (JP); Takamasa Shiraki, Kanagawa (JP); Kohta Takenaka, Kanagawa (JP); Kazushige Kawamura, Kanagawa (JP); Hiroshi Ishii, Kanagawa (JP); Keisuke Shimizu, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 245 days.

(21) Appl. No.: 11/518,898

(22) Filed: Sep. 12, 2006

(65) Prior Publication Data

US 2007/0059036 A1 Mar. 15, 2007

(30) Foreign Application Priority Data

Sep. 15, 2005 (JP) ..... 2005-269289

(51) Int. Cl.
*G03G 15/02* (2006.01)

(52) U.S. Cl. ..... 399/116; 399/121; 399/122

(58) Field of Classification Search ..... 399/107, 399/110, 116, 121, 122
See application file for complete search history.

(56) References Cited

U.S. PATENT DOCUMENTS

| | | | | |
|---|---|---|---|---|
| 5,182,602 | A * | 1/1993 | Kakita et al. | 399/297 |
| 6,292,638 | B1 * | 9/2001 | Nagamine et al. | 399/122 |
| 6,898,407 | B2 | 5/2005 | Noguchi et al. | |
| 6,937,838 | B2 | 8/2005 | Ishii et al. | |
| 6,970,665 | B2 | 11/2005 | Kuma et al. | |
| 6,975,830 | B2 | 12/2005 | Murakami et al. | |
| 7,003,246 | B2 * | 2/2006 | Gogate et al. | 399/122 |
| 7,054,578 | B2 * | 5/2006 | Jung et al. | 399/110 |
| 7,076,189 | B2 * | 7/2006 | Yoshino | 399/121 |
| 2005/0008393 | A1 | 1/2005 | Kuma et al. | |
| 2005/0281594 | A1 | 12/2005 | Kuma et al. | |
| 2006/0008288 | A1 | 1/2006 | Kuma et al. | |
| 2006/0024103 | A1 | 2/2006 | Murakami et al. | |

FOREIGN PATENT DOCUMENTS

| | | |
|---|---|---|
| JP | 63-11922 | 1/1988 |
| JP | 10-301432 | 11/1998 |
| JP | 2000-109235 | 4/2000 |
| JP | 2000-242124 | 9/2000 |
| JP | 2002-296923 | 10/2002 |
| JP | 2002-296927 | 10/2002 |
| JP | 2004-13167 | 1/2004 |

* cited by examiner

*Primary Examiner*—Hoan H Tran
(74) *Attorney, Agent, or Firm*—Oblon, Spivak, McClelland, Maier & Neustadt, P.C.

(57) ABSTRACT

The present invention provides an image forming device capable of forming high-quality images and affording high-precision rotating shaft parallelism between surface mobile bodies, and a unit position adjustment method for adjusting the position of a surface mobile body unit relative to the main body of the image forming device. The image forming device includes a front fixing guide plate as a unit support member for fixing, to a front plate of a structure, a fixing unit serving as a surface mobile body unit which includes a fixing roller being a surface mobile body, and an upper portion eccentric cam and a horizontal portion eccentric cam serving as a unit position adjustment member for adjusting the position of the front fixing guide plate relative to the front plate.

19 Claims, 23 Drawing Sheets

IMAGE FORMING DEVICE AND UNIT POSITION ADJUSTMENT METHOD

BACKGROUND OF THE INVENTION

1. Field of the Invention

The present invention relates to an image forming device having a structure constituting the framework of a device main body, and a surface mobile body unit fixed to the structure and comprising a surface mobile body for supporting/transporting a toner image or a surface mobile body for transporting a recording medium. Further, the present invention relates to a unit position adjustment method of the surface mobile body unit relative to the main body of the image forming device.

2. Description of the Background Art

Conventional electro photographic image forming devices are widely used as copying machines, printers, plotters, fax machines and multifunction devices of the foregoing. In these image forming devices, a photosensitive body, as an image support, is electrically charged by a charging device, and is then exposed by means of an optical writing device or the like to form a latent image on the photosensitive body, this latent image being then developed with a developer agent in a developer device to yield a toner image. After being formed, the toner image is transferred to a sheet-like recording medium in a transfer device, and then the image transferred to the recording medium is fixed in a fixing device, to form thereby an image.

The main body of such image forming devices comprises a structure including steel-made front and rear side plates, a base member, stays and/or frames, and an outer cladding that covers the outer periphery of the structure. Inside the structure are housed, for instance, the photosensitive body, the charging device, the optical writing device, the transfer device, the fixing device, a paper feed device and the like.

When in such image forming devices parallelism cannot be maintained between a fixing roller in the fixing device and a paper transport roller for transporting the recording medium from the paper feed device, the transport directions of these rollers become offset relative to each other, which may give rise to problems such as paper skew and/or trapezoidal image.

Also, if the parallelism cannot be maintained between a rotating shaft of the photosensitive body and a rotating shaft of an intermediate transfer body of the transfer device (rotating shaft of a support roller in case of a belt-like intermediate transfer body), the distance between the photosensitive body and the intermediate transfer body varies along the axial direction, as a result of which the image transferred to the intermediate transfer body may exhibit density unevenness in the axial direction.

Similarly, if parallelism cannot be maintained between the rotating shaft of the intermediate transfer body and a rotating shaft of a paper transport roller, the movement direction of the recording medium in the portion in which the image is transferred to the recording medium and the movement direction of the intermediate transfer body may slant relative to each other, which can result in a slanted image being formed on the recording medium.

The above problems occur thus when parallelism cannot be maintained between surface mobile bodies for supporting/transporting a toner image, such as the photosensitive body, the intermediate transfer body and the like, and surface mobile bodies for transporting the recording medium, such as the paper transport roller, the fixing roller and the like. As a result, it becomes necessary to ensure high-precision parallelism between surface mobile bodies. Ways of improving parallelism between the surface mobile bodies include, for instance, enhancing component precision of the various components, and/or using special assembly jigs for high-precision assembly of the structure and the surface mobile body unit provided with the surface mobile bodies, during assembly of the image forming device.

However, enhancing component precision is both difficult and costly. Apart from inherent limits to component precision, the accumulation of component tolerances in image forming devices comprising a substantial number of components may result eventually in parallelism offset between surface mobile bodies. Ensuring parallelism between surface mobile bodies through enhanced component precision obviously requires reducing variability in the components themselves, but also reducing assembly error during assembly of the device. Assembly error reduction, however, is also subject to limitations.

On the other hand, using assembly jigs during assembly of the device requires a high-precision jig itself, which involves high-difficulty jig design and manufacture. Both the manufacture of the jig and the parallelism enhancement achieved through the use of such a jig are also subject to limitations.

There is thus a pressing need for image forming devices capable of ensuring parallelism between surface mobile bodies, with enhanced precision, in order to cope with ever more demanding high-quality imaging.

Technologies relating to the present invention are disclosed in, e.g.

Japanese Patent Application Laid-open No. 2004-13167,
Japanese Patent Application Laid-open No. 2002-296923,
Japanese Patent Application Laid-open No. 2000-242124,
Japanese Patent Application Laid-open No. 2000-109235,
Japanese Patent Application Laid-open No. S63-011922, and
Japanese Patent Application Laid-open No. H10-301432.

SUMMARY OF THE INVENTION

In light of the above problems, it is a first object of the present invention to provide an image forming device in which high-quality images can be formed thanks to high-precision rotating shaft parallelism between surface mobile bodies.

A second object of the present invention is to provide a unit position adjustment method of a surface mobile body unit relative to the main body in an image forming device. 1.

In an aspect of the present invention, an image forming device comprises a structure forming a framework of a device main body; a surface mobile body unit comprising a surface mobile body for supporting/transporting a toner image, or a plurality of surface mobile bodies for transporting a recording medium, and part of a plurality of surface mobile bodies; the surface mobile body fixed to the structure separately from the surface mobile body unit; a unit support member, being a member other than the structure, for supporting the surface mobile body unit and for fixing the position of the surface mobile body unit to the structure; and a unit position adjustment member for adjusting the position of the unit support member relative to the structure.

In another aspect of the present invention, a unit position adjustment method is provided for adjusting, relative to an image forming device main body, a fixed position of a surface mobile body unit comprising a surface mobile body for supporting/transporting a toner image, or a surface mobile body for transporting a recording medium. The method comprises the step of adjusting, by means of a unit position adjustment member, the position of a unit support member relative to a structure that forms a framework of the image forming device main body. The unit support member is a member other than the structure and fixing the surface mobile body unit to the structure, to adjust thereby the fixed position of the surface mobile body unit relative to the image forming device main body.

BRIEF DESCRIPTION OF THE DRAWINGS

The above and other bodies, features and advantages of the present invention will become apparent from the following detailed description taken with the accompanying drawings in which.

DESCRIPTION OF THE PREFERRED EMBODIMENT(S)

Various embodiments of the present invention are explained in detail below with reference to accompanying drawings.

Embodiment 1

An electro photographic copying machine (hereinafter, copying machine 100) is explained below as one example of an image forming device suitably used in an Embodiment 1.

Figure 1:
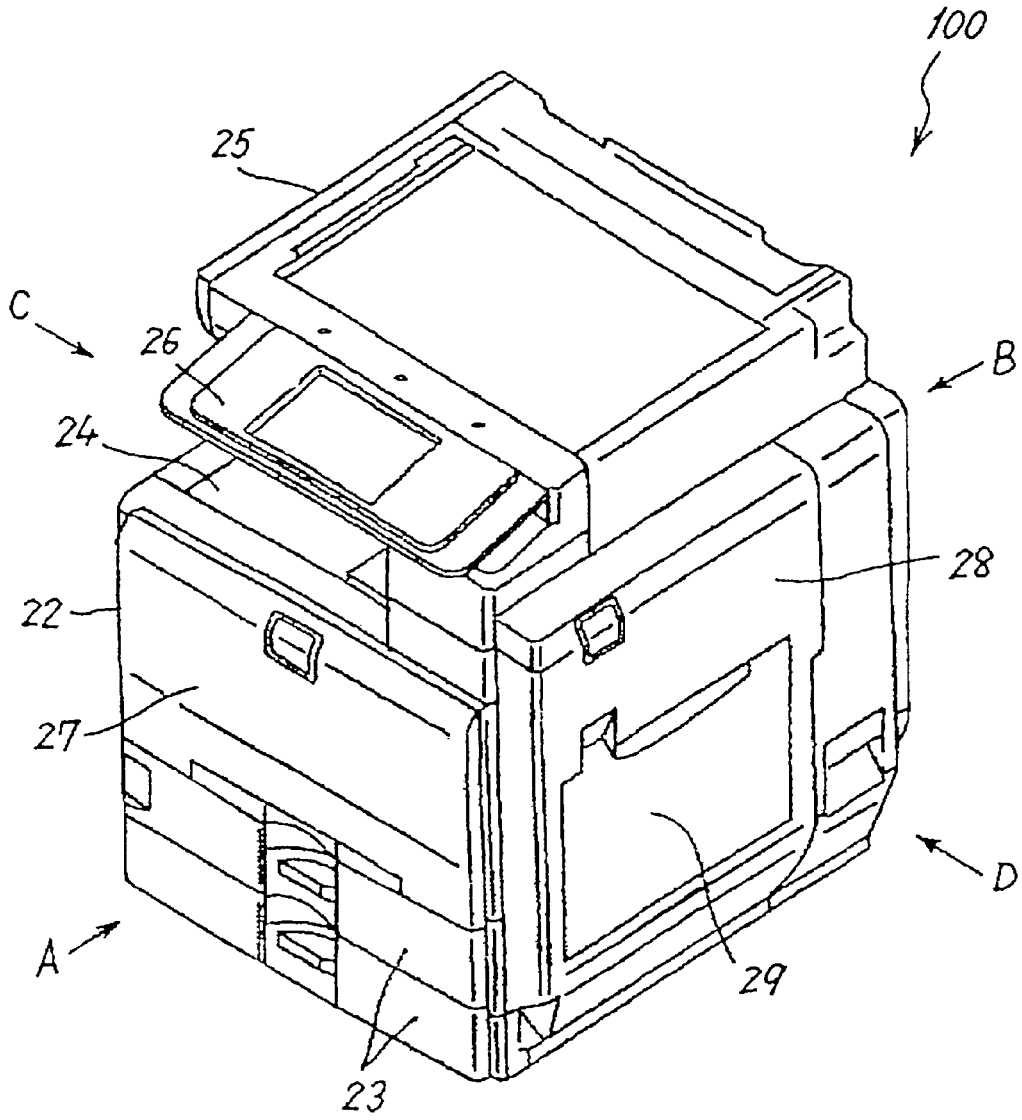
FIG. 1 is a perspective-view diagram of the outer appearance of a copying machine according to Embodiment 1 of the present invention.

FIG. 1 is an external view of the entire copying machine 100 as an image forming device according to Embodiment 1. The image forming device of Embodiment 1 is an example of a copying machine comprising a document capture section and an image forming section, although the image forming device can also be used as a printer, a scanner or a fax machine through a connection via a LAN cable and/or a telephone line.

A printer section 22 is arranged, as the image forming section, in substantially the central portion of a main body of the copying machine 100, with a two-tier paper feed section 23 arranged immediately under the printer section 22. A paper output section 24, called an in-trunk paper output unit, is provided above the printer section 22, with a scanner section 25, as the document capture section, provided above the paper output section 24.

On the front side of the scanner section 25 are provided an operating section 26 having input means (various keys such as a start key, a numerical keypad, a function setting key, a reset key, a clear/stop key and the like) for operating plural functions of the copying machine 100, and display means (liquid-crystal display panel, liquid-crystal touch panel doubling as the input means, or the like) for displaying input information and/or device status.

Figure 2:
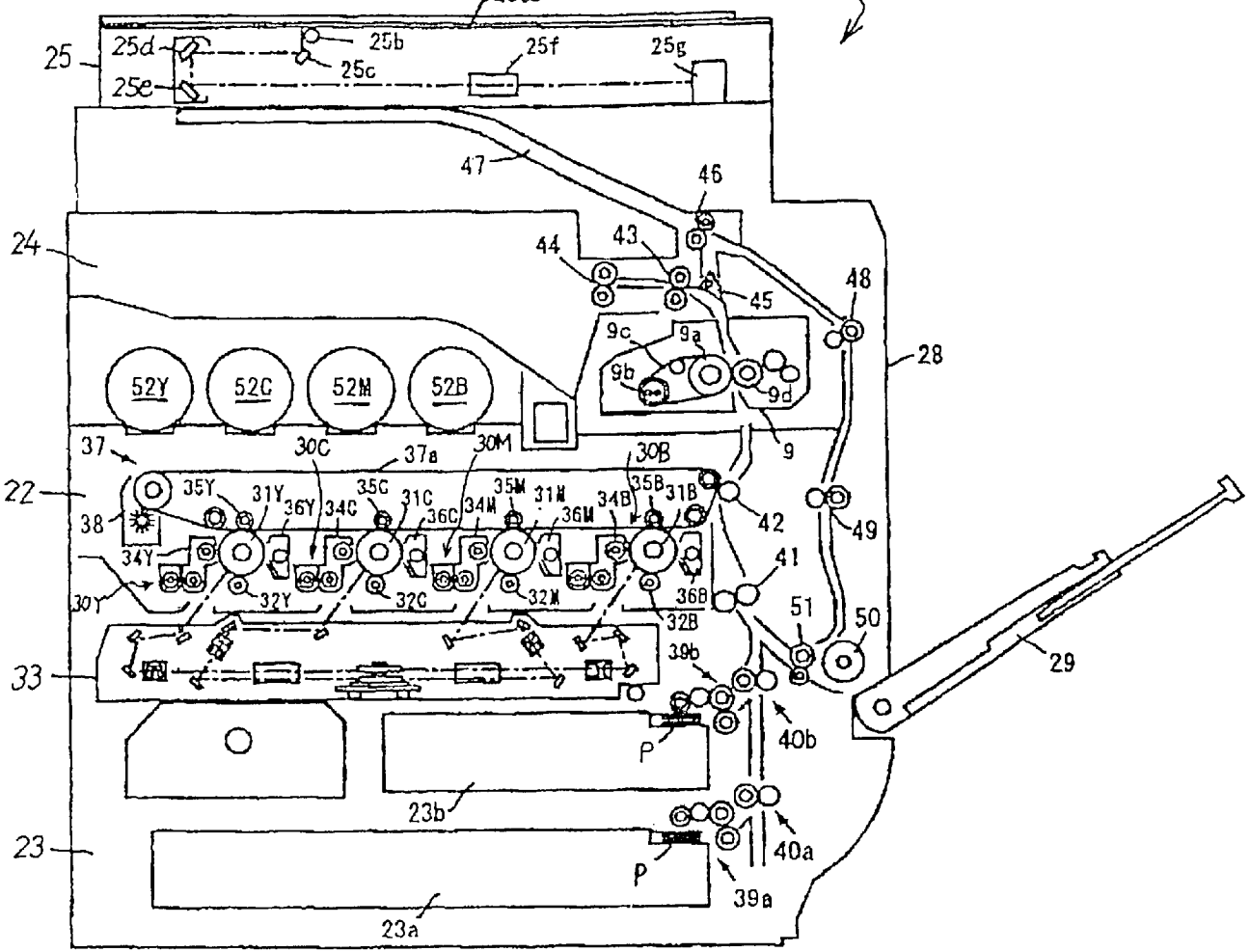
FIG. 2 is a diagram illustrating the schematic constitution of the copying machine.

FIG. 2 illustrates schematically the constitution of the copying machine 100. As illustrated in the figure, the scanner section 25 above the printer section 22 comprises for instance a contact glass 25*a*, which is a document platen where the document is placed, and an illuminating light source 25*b* for illuminating the document. The scanner section 25 comprises also, for instance, a first mirror 25*c*, a second mirror 25*d*, and a third mirror 25*e* for reflecting the light reflected by the document, an imaging lens 25*f* for imaging the light reflected by the document, and an image sensor 25*g* as the capture means, such as a CCD or the like, arranged on the imaging position of the imaging lens 25*f*, for document image capture. On the scanner section 25 are also provided, for instance, a pressure plate for pressing down the document placed on the contact glass 25*a*, and/or an automatic document feeding device (ADF), not shown, for automatically feeding documents to the contact glass 25*a*.

The printer section 22, which is provided in the central section of the copying machine 100, comprises four image forming units 30Y, 30C, 30M, 30B for forming images of the colors yellow (Y), cyan (C), magenta (M) and black (B). Above the image forming units 30Y, 30C, 30M, 30B is arranged an intermediate transfer unit 37 having an intermediate transfer belt 37*a* which is an endless belt-type intermediate transfer body, while on the underside of the image forming units 30Y, 30C, 30M, 30B is arranged an optical writing device 33.

The constitutions of the image forming units 30Y, 30C, 30M, 30B are identical. Each of the image forming units 30Y, 30C, 30M, 30B has a respective photosensitive drum 31Y, 31C, 31M, 31B, as an image support. Around the image forming units 30Y, 30C, 30M, 30B are also arranged, respectively, charging devices 32Y, 32C, 32M, 32B, developer devices 34Y, 34C, 34M, 34B, primary transfer rollers 35Y, 35C, 35M, 35B, and cleaning devices 36Y, 36C, 36M, 36B, dedicated to the respective photosensitive units.

The optical writing device 33, which is arranged opposite the four image forming units 30Y, 30C, 30M, 30B, has in the center thereof one deflector, such that light beams from four light sources are distributed, deflected and scanned in sets of four by one deflector, to write latent images on the four photosensitive drums 31Y, 31C, 31M, 31B. The optical writing device 33 comprises four laser diode (LD) light sources of prepared for each color, an optical system for collimating the laser beams emitted by the light sources, one deflector (polygon scanner) constituted by a polygon mirror (rotating multiple mirror) and a polygon motor, and an optical system comprising for instance lenses, correcting lenses, mirrors and the like for scanning/image formation by fθ lenses arranged in the optical paths of the respective light sources. The laser light beams emitted by the laser diodes in response to image information of the respective color are deflected and scanned by the polygon scanner and are projected onto the photosensitive drums 31Y, 31C, 31M, 31B of the respective color.

Between the printer section 22 and the paper output section 24 are provided toner bottles 52Y, 52C, 52M, 52B for supplying toner to the developer devices 34Y, 34C, 34M, 34B of the respective image forming units 30Y, 30C, 30M, 30B. The toner bottles 52Y, 52C, 52M, 52B are filled, respectively, from the left of the figure, with yellow (Y), cyan (C), magenta (M) and black (B) toner. Toner of the respective color is supplied from the toner bottles 52Y, 52C, 52M, 52B, in a predetermined replenishment amount, to the developer devices 34Y, 34C, 34M, 34B, via a transport path not shown.

The intermediate transfer belt 37*a* of the intermediate transfer unit 37, which is supported by a driving roller, a driven roller and a primary transfer roller, moves in the direction indicated by the arrow in the figure. A secondary transfer roller 42 is provided on the right side of the intermediate transfer belt 37*a*. On the left side of the intermediate transfer belt 37*a* is provided an intermediate transfer belt cleaning device 38.

In the paper feed section 23 below the copying machine 100 are arranged in two tiers a first paper feed cassette 23*a* and a second paper feed cassette 23*b* in which is stored recording paper P as the recording medium. The recording paper P is fed out of either the first paper feed cassette 23*a* or the second paper feed cassette 23*b* by means of a first paper feed device 39*a* or a second paper feed device 39*b*, and is supplied towards a registration roller 41 via a first transport roller 40*a* or a second transport roller 40*b*. The recording paper P supplied to the registration roller 41 is transported at a predetermined timing towards a secondary transfer roller 42.

A fixing unit 9 is arranged above the secondary transfer roller 42. In the fixing unit 9 are provided, for instance, a fixing belt 9*c* supported on a fixing roller 9*a* and a heating roller 9*b*, and a pressure roller 9*d* pressing against the fixing belt 9*c*. Above the fixing unit 9 is provided a transport roller 43 and/or a paper output roller 44 for transporting and delivering the paper towards the paper output section 24. Above the fixing unit 9 are further provided a flapper 45 for switching the transport path during duplex printing and/or a reverse transport roller 46 and reverse transport path 47 for reversing the direction of the paper in a switchback mode. The direction of the paper temporarily stacked on the reverse transport path 47 is reversed by the reverse transport roller 46 and the paper is transported along a duplex transport path by a first duplex transport roller 48 and a second duplex transport roller 49, to be re-fed to the registration roller 41.

The operation of the image forming device is explained next.

For copying a document, a pressure plate is opened and the document is set on the contact glass 25*a* of the scanner section 25, or alternatively the document is set on an ADF document platen not shown. When a start switch of the operating section 26 is pressed, and the document is set in the ADF, the document is transported onto the contact glass 25*a*, whereupon the scanner section 25 is driven. On the other hand, the scanner section 25 is driven immediately when the document is set on the contact glass 25*a*. A first vehicle having the light source 25*b* and the first mirror 25*c*, as well as a second vehicle having the second mirror 25*d* and the third mirror 25*e* start moving then. The light emitted by the light source 25*b* and reflected by the document is reflected by the first mirror 25*c* towards the second vehicle, is reflected by the second mirror 25*d* and the third mirror 25*e* of the second vehicle, and passes through the imaging lens 25*f* to impinge on the image sensor 25*g*, where the content of the document is captured. In case of mode setting in the operating section 26, or when automatic mode selection is set in the operating unit, the image forming operation is initiated in a full-color mode or black and white mode, in accordance with the document capture result.

In the printer section 22, the photosensitive drums 31Y, 31C, 31M, 31B are first uniformly charged by the charging devices 32Y, 32C, 32M, 32B. The photosensitive drums 31Y, 31C, 31M, 31B are then exposed and scanned with laser light from the optical writing device 33 having a deflector sharing four laser light sources and a four-set optical system, whereby electrostatic latent images are formed on the photosensitive drums 31Y, 31C, 31M, 31B. These electrostatic latent images are developed by the respective developer devices 34Y, 34C, 34M, 34B, to form yellow, cyan, magenta and black toner images on the surfaces of the photosensitive drums 31Y, 31C, 31M, 31B, respectively.

A primary transfer voltage is applied next to the primary transfer rollers 35Y, 35C, 35M, 35B, and the toner on the photosensitive drums 31Y, 31C, 31M, 31B is transferred sequentially to the intermediate transfer belt 37*a*. The image creation operation is performed upstream to downstream, with staggered timings, so that the toner image of each color is transferred to become superposed on the same position of the intermediate transfer belt 37*a*.

With a timing in step with the above-described primary transfer operation, the recording paper P, as the recording material, is fed then out of either the first paper feed cassette 23*a* or the second paper feed cassette 23*b* of the paper feed section 23 by the first paper feed device 39*a* and the second paper feed device 39*b*. Alternatively, the paper is fed out of a manual paper feed table 29 by a paper feed roller 50. When the leading edge of the recording paper P reaches the registration roller 41, a sensor not shown detects the paper and the recording paper P is transported by the registration roller 41, with a timing taken from a detection signal, to a secondary transfer nip portion between the secondary transfer roller 42 and the intermediate transfer belt 37*a*.

The image formed on the intermediate transfer belt 37*a* is transported to the position of the secondary transfer roller 42, and is secondary-transferred in block to the recording paper P.

The recording paper P with the image transferred thereon is transported to the fixing unit 9, where the image is fixed through heat and pressure, and the recording paper P is transported by the transport roller 43 towards the paper output section 24 and is outputted by the paper output roller 44. A color image can be obtained as a result on the recording paper P.

When duplex copying is carried out through selection of a duplex mode in the operating section 26, a flapper 45 switches the transport path, so that the recording paper P already fixed is temporarily stacked in the reverse transport path 47, after which the transport direction is reversed in a switchback fashion by the reverse transport roller 46. With a timing in step with the image formation operation, the recording paper P is transported then along the duplex transport path, by the first duplex transport roller 48 and the second duplex transport roller 49, to be re-fed to the registration roller 41. The recording paper P is then fed again by the registration roller 41 to the secondary transfer section, where an image is transferred to the reverse side of the recording paper P. The recording paper P with an image formed also on the reverse side is then transported to the fixing unit 9, where the images are fixed through heat and pressure, is transported by the transport roller 43 towards the paper output section 24, and is outputted by the paper output roller 44. A color image can be obtained as a result on both faces of the recording paper P.

Residual toner in the photosensitive drums 31Y, 31C, 31M, 31B is cleaned by the respective cleaning devices 36Y, 36C, 36M, 36B. Charge removal and charging are then carried out simultaneously by the charging devices 32Y, 32C, 32M, 32B, in which is applied an AC component bias superposed to a direct current, to prepare for the next image creation operation.

The residual toner on the intermediate transfer belt 37*a* is cleaned by the intermediate transfer belt cleaning device 38, to prepare for the next image creation step.

The internal constitution of the image forming device of the present invention, however, is not limited to that of the example explained above. That is, the example of FIG. 2 illustrates a tandem-type image forming section, but a color image forming section may be used instead having a constitution in which there are provided one photosensitive body and plural developer devices and intermediate transfer bodies (so-called one drum-intermediate transfer). The image forming section may also be a monochrome-type image forming section in which are formed images of a single color.

The constitution exemplified in FIG. 1 included a scanner section 25, but it may also be that of a printer when the scanner section 25 is removed.

The assembly of the copying machine 100 is explained next.

Figure 3:
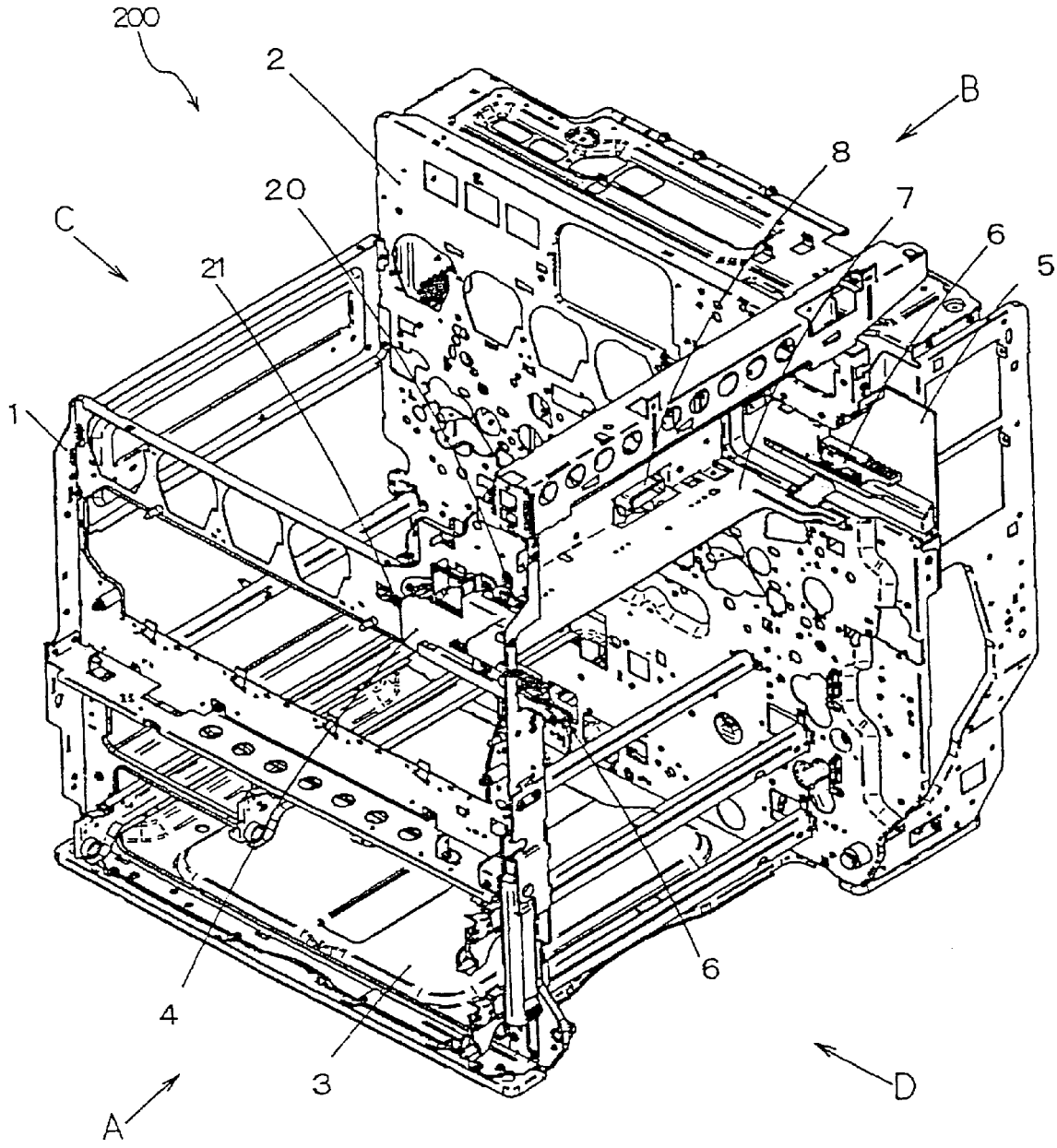
FIG. 3 is a perspective-view diagram illustrating the constitution of a structure of the copying machine.

In the copying machine 100 illustrated in FIG. 1, the device main body in which are arranged the printer section 22 and the paper feed section 23 has, in the inner portion of the outer cladding, a structure 200 built as the one illustrated in FIG. 3. In FIGS. 1 and 3, the side of arrow A is the device front side, the side of arrow B is the device rear side, the side of arrow C is the device left side, the side of arrow D is the device right side.

The structure 200 comprises, for instance, a metal-made base 3, a front plate 1, a rear plate 2, a fixing lower stay 7, a frame and fastening members (screws, bolts, nuts and the like) made of steel. The outer cladding of the device comprises members such as an exterior cover, a front open-close door 27, a lateral open-close door 28 and the like, for instance formed by plastic molding. The front open-close door 27 of the outer cladding is provided so as to be able to open and close relative to the exterior cover, in order to facilitate maintenance operations for changing toner bottles or servicing the image forming section. The right lateral open-close door 28 is provided to facilitate operations such as mounting and removal of the fixing unit, elimination of jammed paper in case of paper jams, and the like. The manual paper feed table 29 is also provided in the horizontal open-close door 28 so as to be able to open and close.

Next is explained the assembly into the structure 200 of the fixing unit 9, which is the surface mobile body unit comprising the fixing belt 9*c* and the pressure roller 9*d* as surface mobile bodies.

FIG. 3 illustrates the construction of the structure 200 of the copying machine 100. The structure 200 comprises a front fixing guide plate 4 and a rear fixing guide plate 5, as the unit support member, for supporting the resin-made fixing unit 9 to the steel-made front plate 1 and rear plate 2.

Figure 4:
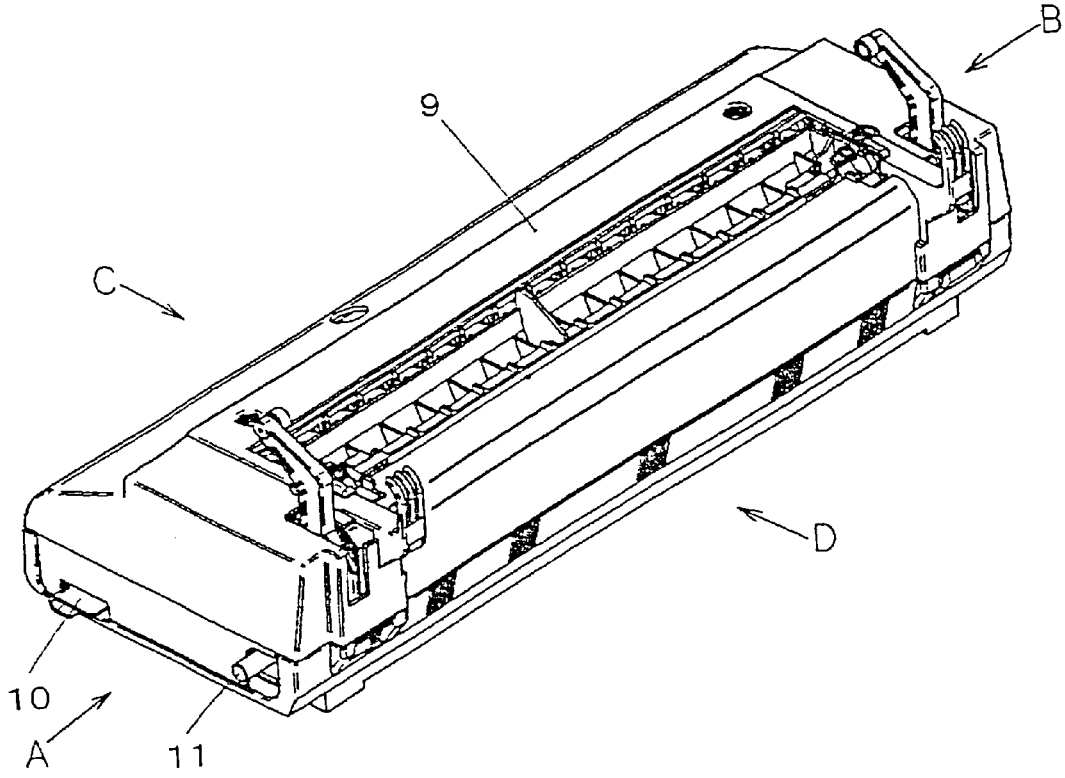
FIG. 4 is a perspective-view diagram of the outer appearance of a fixing unit used in the copying machine.
Figure 5:
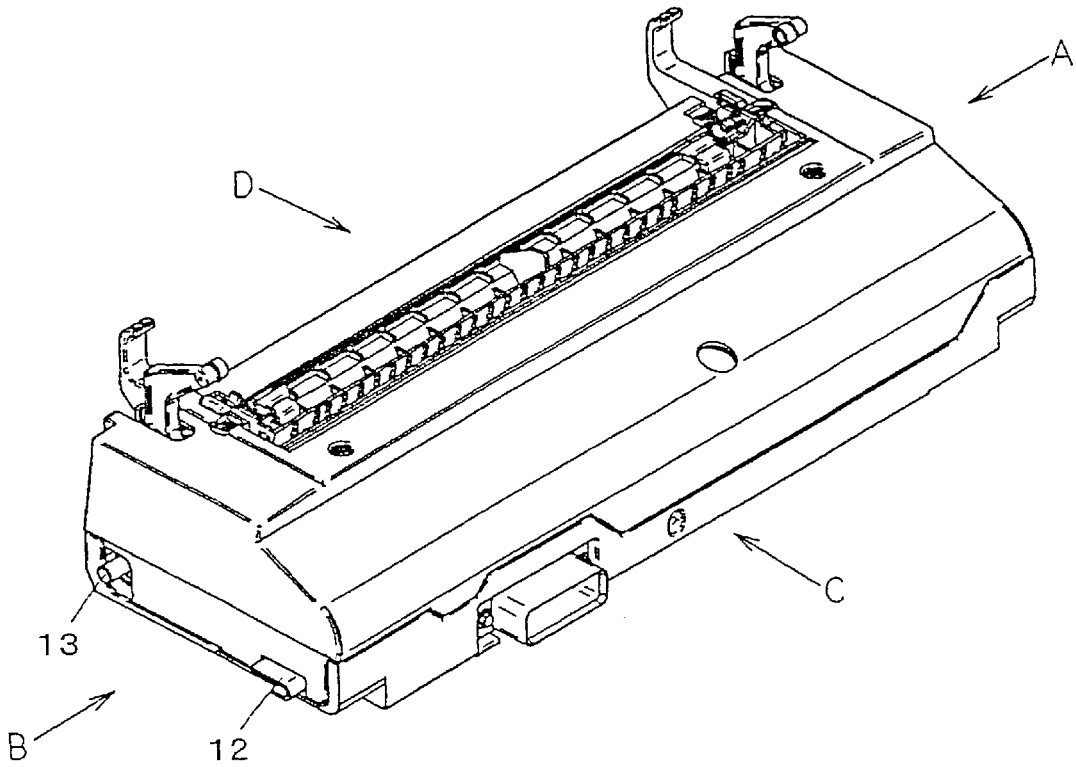
FIG. 5 is a perspective-view diagram of the outer appearance of the fixing unit viewed from another direction.

FIG. 4 illustrates the outer appearance, viewed from the side of the front plate 1, of the fixing unit 9 when set in the structure 200, the fixing unit 9 being herein set on the front fixing guide plate 4 and the rear fixing guide plate 5 mounted to the structure 200. FIG. 5 illustrates the outer appearance of the fixing unit 9 when set in the structure 200, viewed from the side of the rear plate 2. The arrows in FIGS. 4 and 5 denote directions when the fixing unit 9 is set in the structure 200 illustrated in FIG. 3, such that the side of arrow A is the device front side, the side of arrow B is the device rear side, the side of arrow C is the device left side and the side of arrow D is the device right side.

The fixing unit 9 comprises a front fixing primary reference 10 and a rear fixing primary reference 12 for fixing the position of the fixing unit 9 relative to the structure 200 in the vertical and right-left directions, and a front fixing subordinate reference 11 and a rear fixing subordinate reference 13 for fixing the position of the fixing unit 9 relative to the structure 200 in the vertical direction only.

Figure 6A:
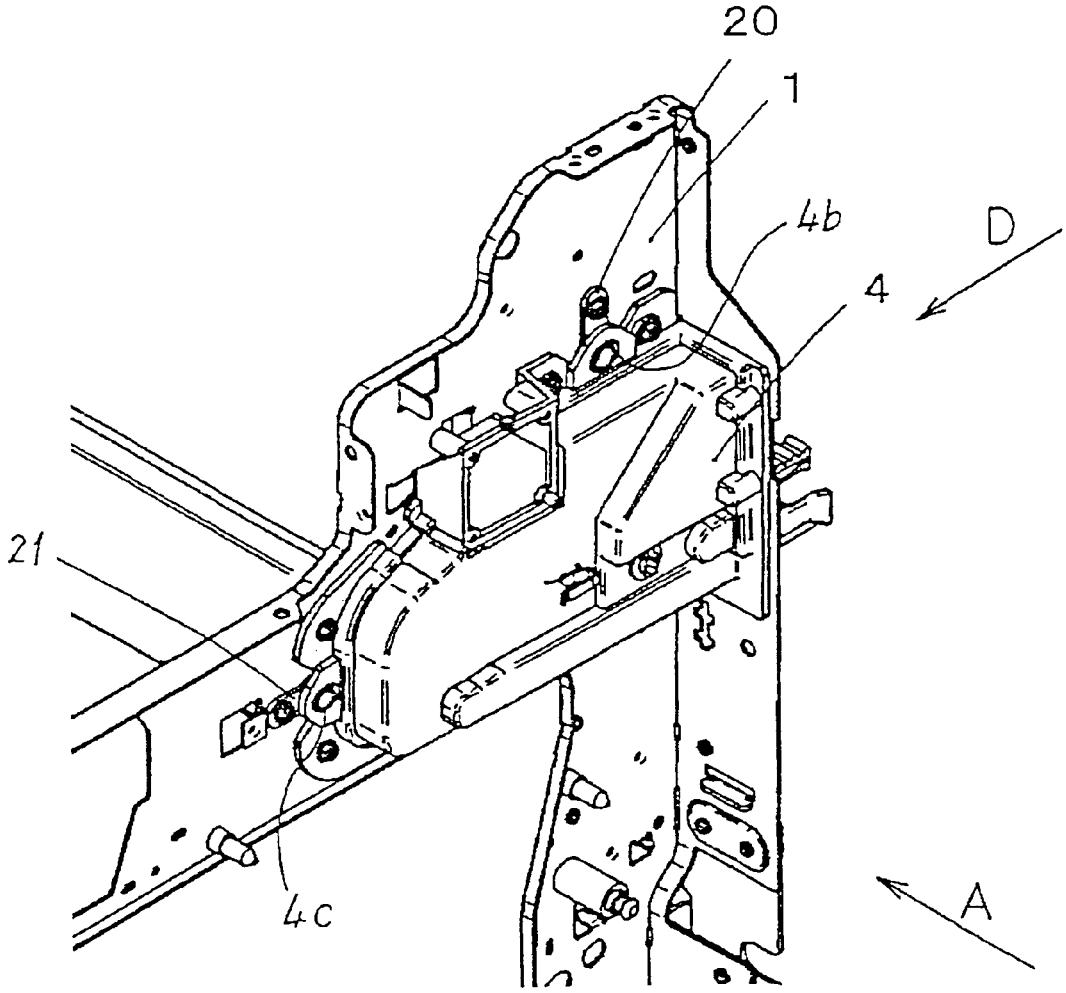
FIG. 6A is a perspective-view diagram illustrating, from the front side, a relevant portion of a fixing guide plate mounted on a front plate of the structure.
Figure 6B:
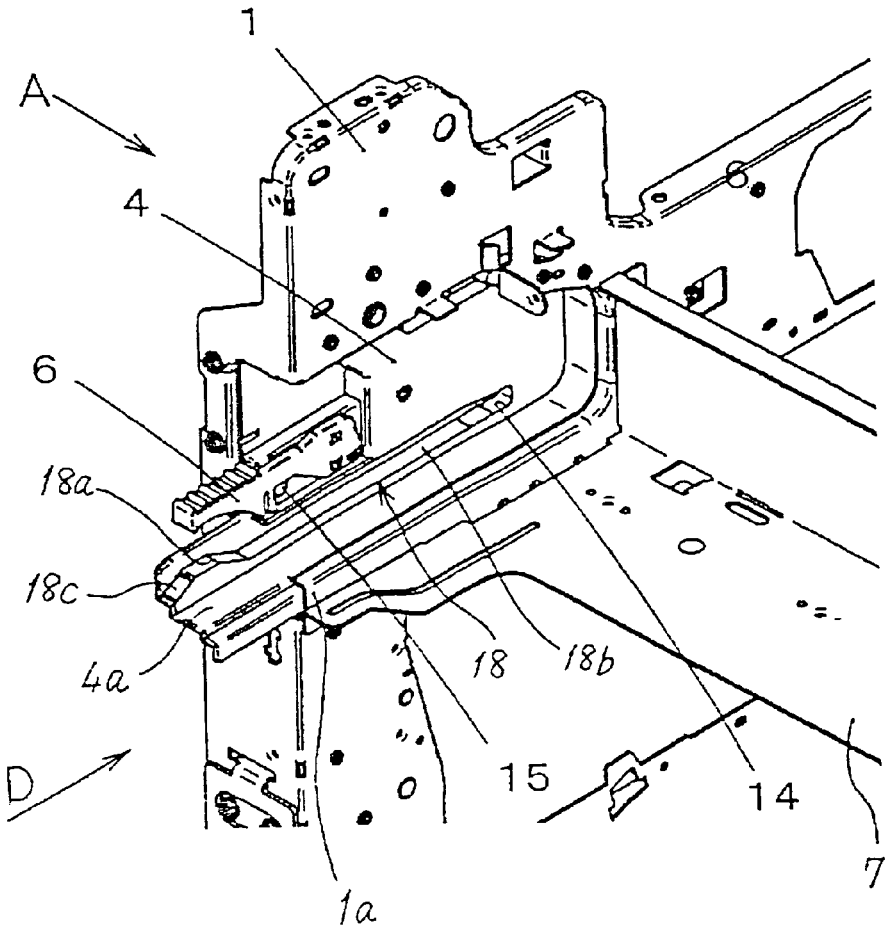
FIG. 6B is a perspective-view diagram of the same viewed from the rear side.
Figure 7A:
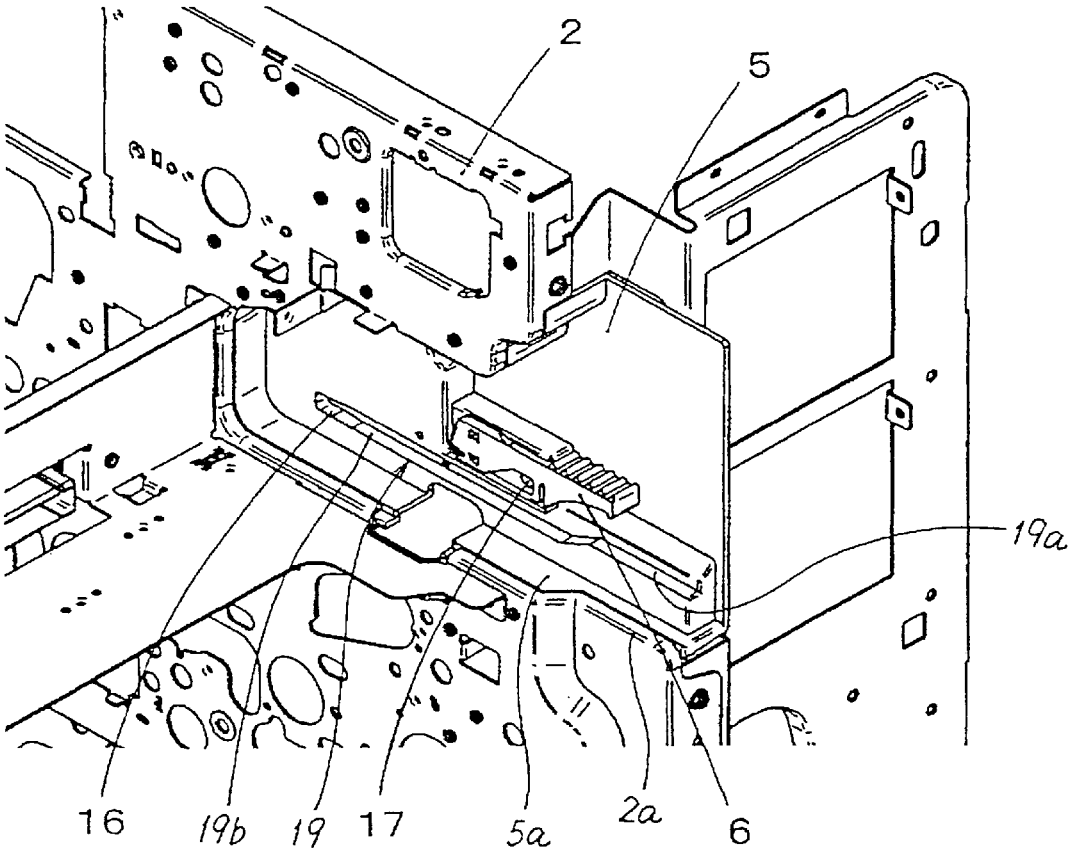
FIG. 7A is a perspective-view diagram illustrating, from the front side, a relevant portion of the fixing guide plate mounted on a rear plate of the structure.
Figure 7B:
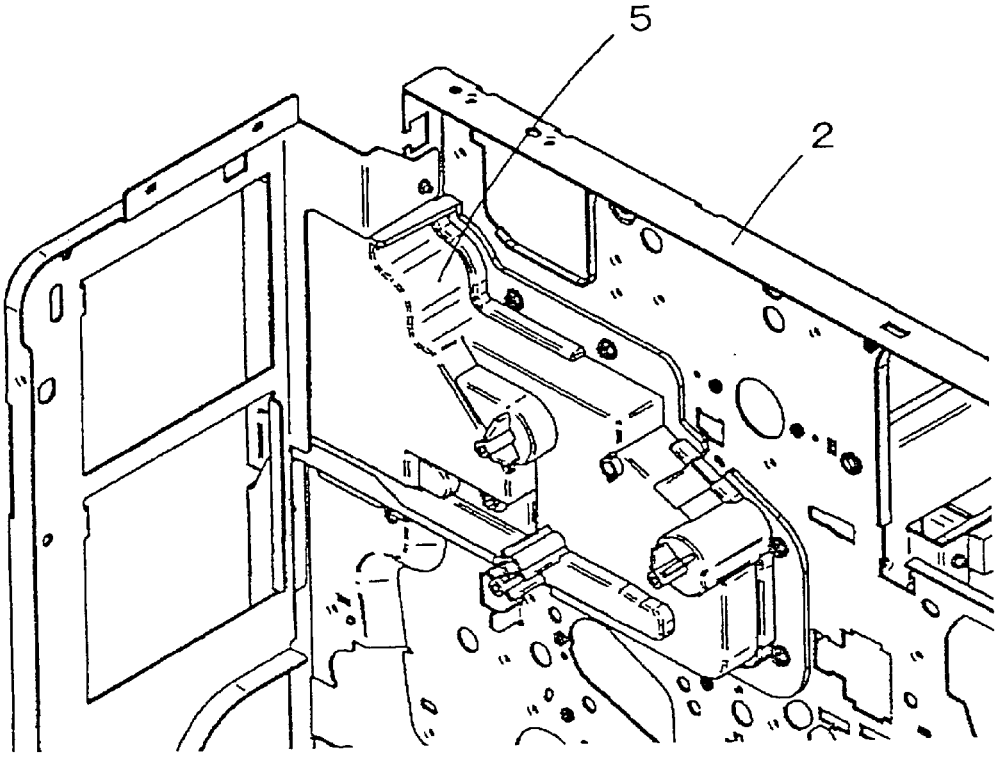
FIG. 7B is a perspective-view diagram of the same viewed from the rear side.

FIGS. 6A and 6B are perspective-view diagrams illustrating the front fixing guide plate 4 mounted on the front plate 1 of the structure 200. FIG. 6A is a perspective diagram viewed from the side of the front plate 1 (direction of arrow A), and FIG. 6B is a perspective diagram viewed from the side of the rear plate 2 (direction of arrow B). FIGS. 7A and 7B are perspective view diagrams illustrating the rear fixing guide plate 5 mounted on the rear plate 2 of the structure 200. FIG. 7A is a perspective diagram viewed from the side of the front plate 1 (direction of arrow A), and FIG. 7B is a perspective diagram viewed from the side of the rear plate 2 (direction of arrow B).

In the copying machine 100, the front plate 1 and rear plate 2 of the structure 200 are cutout in portions where the fixing unit 9 fits, the front fixing guide plate 4 and the rear fixing guide plate 5 mounted and screwed in these portions after having been molded through resin molding using a fiber reinforced resin or the like. A highly rigid structure 200 can be thus obtained by fastening to the cutouts of the structure 200 the front fixing guide plate 4 and the rear fixing guide plate 5 after having been resin molded.

As illustrated FIG. 6A, an upper portion circular hole 4*b* and a side portion circular hole 4*c* are provided in the front fixing guide plate 4, with respective circular holes being also provided in the front plate 1 at positions opposite the upper portion circular hole 4*b* and the side portion circular hole 4*c*. An upper portion cam member 20 and a horizontal portion cam member 21 described in detail below, as a unit position adjustment member, are mounted in the guide upper portion circular hole 4*b* and the circular hole opposite thereto, and in the guide side portion circular hole 4*c* and the circular hole opposite thereto.

Also, as illustrated FIG. 6B, a front plate turn-back portion 1*a* engaging with a front guide outer peripheral portion 4*a* of the front fixing guide plate 4 is provided along the edge of the cutout portion of the front plate 1. Similarly, as illustrated FIG. 7A, a rear plate turn-back portion 2*a* engaging with a rear guide outer peripheral portion 5*a* of the rear fixing guide plate 5 is provided along the edge of the cutout portion of the rear plate 2. The front plate turn-back portion 1*a* and the rear plate turn-back portion 2*a* allow reinforcing the rigidity of the fixing portions of the front fixing guide plate 4 and the rear fixing guide plate 5, while improving the hermetic of the outer peripheral portions of the front fixing guide plate 4 and the rear fixing guide plate 5.

In the front fixing guide plate 4 fixed to the structure 200 are provided a front guide primary reference 14 for positioning the front fixing primary reference 10, and a front guide subordinate reference 15 for positioning the front fixing subordinate reference 11, on the side of the fixing unit 9. Similarly, in the rear fixing guide plate 5 fixed to the structure 200 are provided a rear guide primary reference 16 for positioning the rear fixing primary reference 12, and a rear guide subordinate reference 17 for positioning the rear fixing subordinate reference 13, on the side of the fixing unit 9. In addition, pivoting-type fixing lock levers 6 are mounted in the vicinity of the front guide subordinate reference 15 and the rear guide subordinate reference 17 of the front fixing guide plate 4 and the rear fixing guide plate 5.

In such a constitution, the internal shape of the fixing guide members allows supporting the fixing unit 9 with good precision upon positioning and fixing of the fixing unit 9. In the front fixing guide plate 4 and the rear fixing guide plate 5 are further provided a front fixing guide rail 18 and a rear fixing guide rail 19, as rail-shaped fixing guide portions, for guiding the fixing unit 9 upon mounting/detachment thereof. The front fixing guide rail 18 and the rear fixing guide rail 19 extend substantially in the horizontal direction from the entrance towards the far side of the front fixing guide plate 4 and the rear fixing guide plate 5. The front guide primary reference 14 and the rear guide primary reference 16 are provided furthest to the back of the front fixing guide rail 18 and the rear fixing guide rail 19, respectively.

Since the front fixing guide plate 4 and the rear fixing guide plate 5 of the copying machine 100 are formed through resin molding, a smooth stepped-shape can be formed in the front fixing guide rail 18 and the rear fixing guide rail 19. The stepped shape of the front fixing guide rail 18 and the rear fixing guide rail 19 includes high entrance sides 18*a* and 19*a* in the insertion direction of the fixing unit 9, (direction of arrow D in the figure), lower far sides 18*b* and 19*b*, and a smooth slanting face in the middle of the stepped portion. A taper 18*c* is provided in the entrance of the front fixing guide rail 18 of the front fixing guide plate 4.

Figure 8:
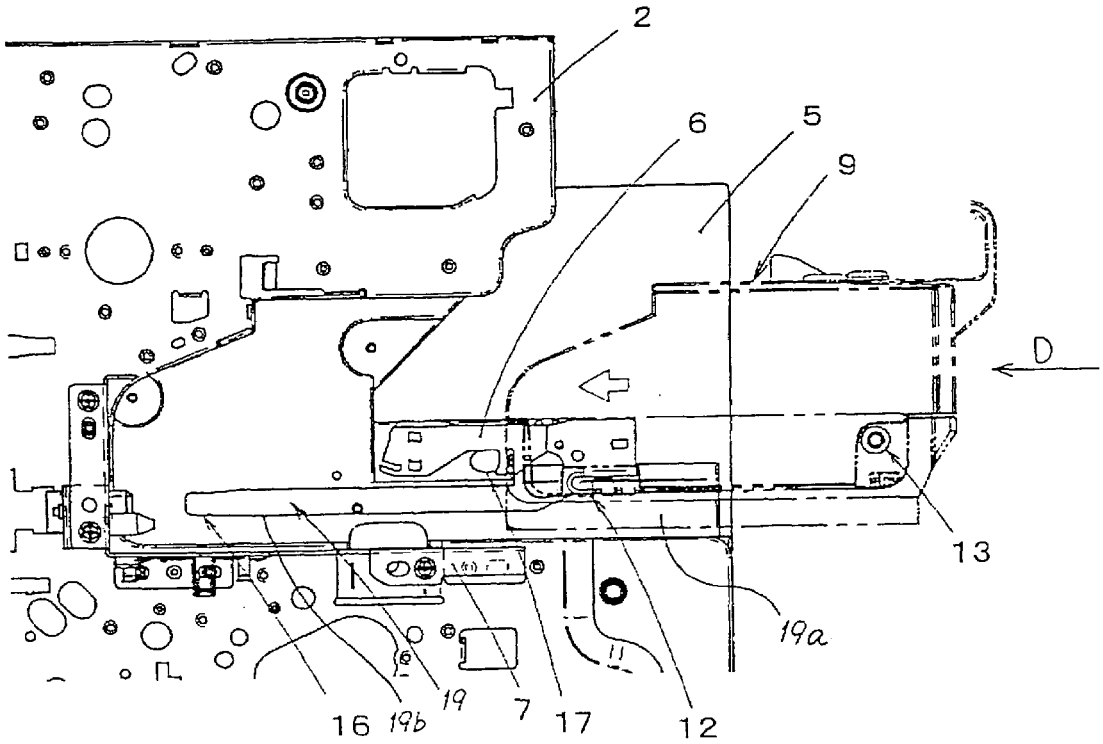
FIG. 8 is a diagram illustrating an initial stage of the fixing unit being set in the fixing guide plate fixed to the structure.
Figure 9:
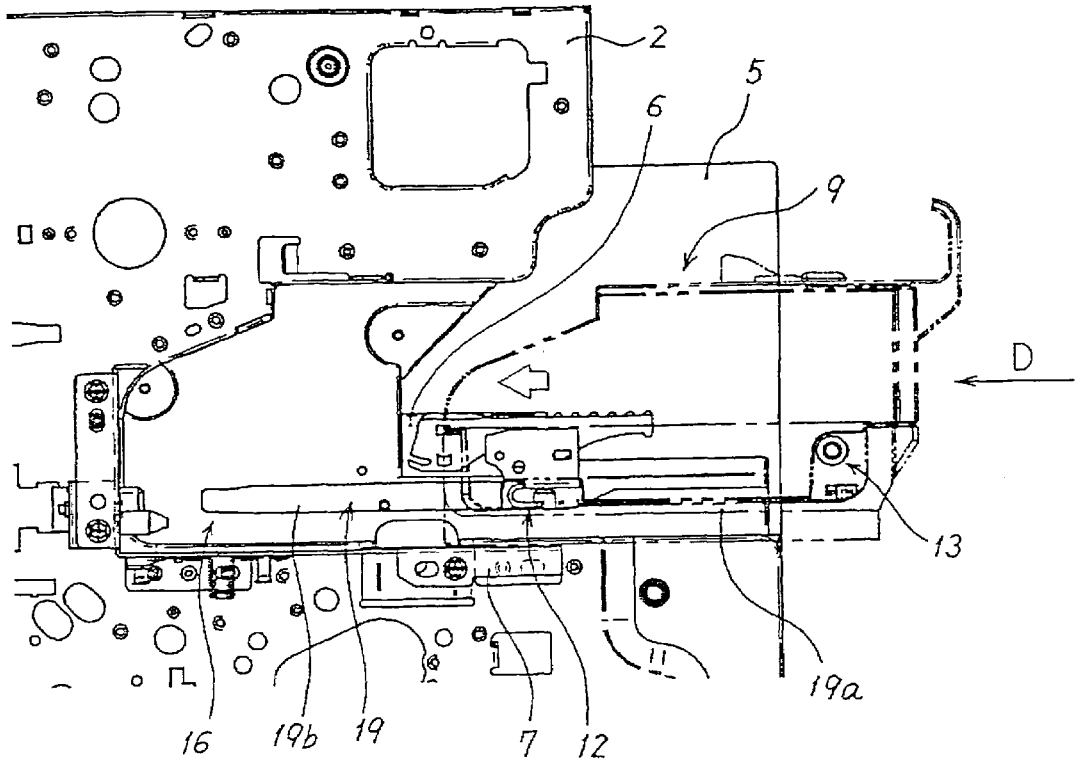
FIG. 9 is a diagram illustrating the fixing unit in the middle of being set in the fixing guide plate fixed to the structure.
Figure 10:
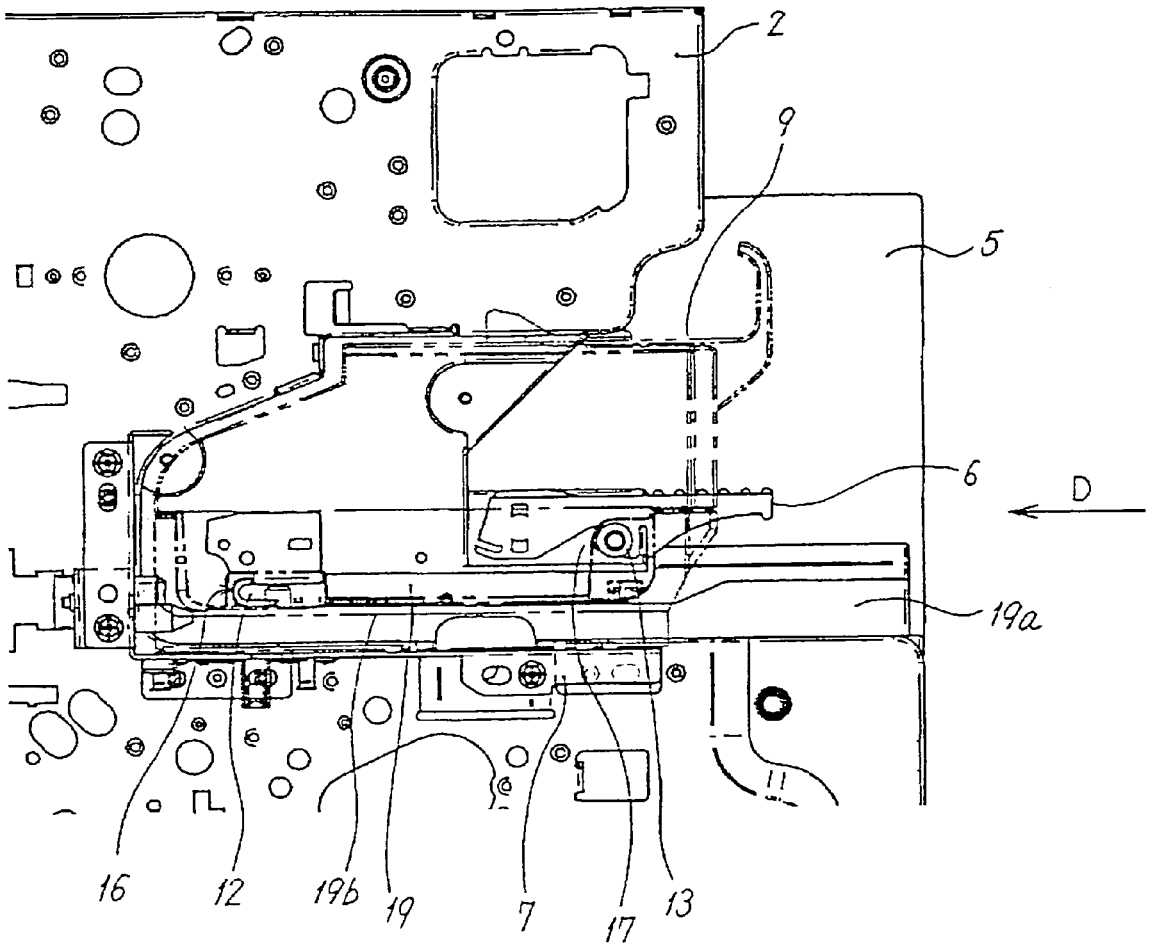
FIG. 10 is a diagram illustrating the fixing unit after being set in the fixing guide plate fixed to the structure.

FIGS. 8 through 10 illustrate the movement of the fixing unit 9 inserted towards the left of the figure (in the direction of arrow D) as it is being set in the front fixing guide plate 4 and the rear fixing guide plate 5 fixed to the structure 200. Although in FIGS. 8 through 10 are illustrated the positions of the fixing unit 9 relative to the rear fixing guide plate 5 fixed to the rear plate 2, the same positional relationships apply also to the front fixing guide plate 4.

Firstly, FIG. 9 illustrates the rear fixing primary reference 12 of the fixing unit 9 as it is inserted in the raised stepped portion of the entrance side 19*a* of the rear fixing guide rail 19 of the rear fixing guide plate 5. Herein, the front fixing primary reference 10 of the fixing unit 9 is similarly inserted in the raised stepped portion of the entrance side 18*a* of the front fixing guide rail 18 of the front fixing guide plate 4. In this situation, the fixing unit 9 is received at a raised position higher than a predetermined position, so that the contour of the fixing unit 9 does not abut the end face of the fixing lower stay 7 even if the fixing unit 9 is set tilted at an angle. The rear-side insertion positions are barely visible upon insertion of the fixing unit 9 in the front fixing guide rail 18 and the in rear fixing guide rail 19 of the front fixing guide plate 4 and the rear fixing guide plate 5, and hence the rear fixing primary reference 12 is inserted first in the entrance side 19*a* of the rear fixing guide rail 19 of the rear fixing guide plate 5, with the fixing unit 9 at a slight tilt, and next the front fixing primary reference 10 is inserted in the entrance side 18*a* of the front fixing guide rail 18 of the front fixing guide plate 4. The taper 18*c* provided at the entrance of the front fixing guide rail 18 of the front fixing guide plate 4 allows easily placing the fixing unit 9 in the stepped portion of the entrance side 18*a* of the front fixing guide rail 18 by inserting the front fixing primary reference 10 of the front side of the fixing unit 9 along the taper 18*c*.

In FIG. 9, the fixing unit 9 has moved to the left from the situation of FIG. 8, and the rear fixing primary reference 12 of the fixing unit 9 is passing along the smooth stepped portion of the rear fixing guide rail 19 at a position beyond the end face of the fixing lower stay 7. On the side of the front fixing guide plate 4, similarly, the front fixing primary reference 10 of the fixing unit 9 is passing along the smooth stepped portion of the front fixing guide rail 18 at a position beyond the end face of the fixing lower stay 7.

As illustrated FIG. 9, the front fixing primary reference 10 and the rear fixing primary reference 12 of the fixing unit 9 drop to a position of the far sides 18*b* and 19*b*, lower than the steps of the front fixing guide rail 18 and the rear fixing guide rail 19.

In FIG. 10, the fixing unit 9 has moved to the left from the situation of FIG. 9. As illustrated FIG. 10, when the fixing unit 9 reaches the furthest position of the rear fixing guide rail 19, the rear fixing primary reference 12 of the fixing unit 9 abuts the rear guide primary reference 16 of the rear fixing guide rail 19. On the side of the front fixing guide plate 4, meanwhile, when the fixing unit 9 reaches the furthest position of the front fixing guide rail 18, the front fixing primary reference 10 of the fixing unit 9 abuts similarly the front guide primary reference 14 of the front fixing guide rail 18.

At the same time, the front fixing subordinate reference 11 and the rear fixing subordinate reference 13 of the fixing unit 9 engage the front guide subordinate reference 15 and the rear guide subordinate reference 17 of the front fixing guide plate 4 and the rear fixing guide plate 5, to set thereby the fixing unit 9. In this set state, the two fixing lock levers 6 latch respectively with the front fixing subordinate reference 11 and the rear fixing subordinate reference 13 of the fixing unit 9, affording thereby a reliably fixing of the fixing unit 9.

In the copying machine 100, thus, the front fixing guide plate 4 and the rear fixing guide plate 5 are formed through resin molding, while the front fixing guide rail 18 and rear fixing guide rail 19 are provided with steps. As a result, the fixing unit 9 can be set smoothly by being moved vertically using the steps of the front fixing guide rail 18 and the rear fixing guide rail 19, even in the presence of components such as the fixing lower stay 7 or the like in the vicinity of the fixing unit 9.

In the copying machine 100 can be realized thus a highly rigid structure comprising the resin-made front fixing guide plate 4 and rear fixing guide plate 5, with high hermetic and a great degree of design freedom. Support with high precision can thus be achieved, so that the fixing unit 9 can be supported/fixed reliably without the need of additional components, even in case of close height and/or positional relationships between the primary and subordinate references. Moreover, the fixing unit 9 can be set smoothly using the stepped shape of the front fixing guide rail 18 and the rear fixing guide rail 19, even in the presence of components such as the fixing lower stay 7 or the like in the vicinity of the fixing unit 9.

When the fixing guide members are made of steel plate, also, it is difficult to provide smooth steps in rail portions formed in such fixing guide members.

Next will be explained the upper portion cam member 20 and the horizontal portion cam member 21, as unit position adjustment members, for adjusting the position of the front fixing guide plate 4 as the unit support member in the structure 200.

Figure 11A:
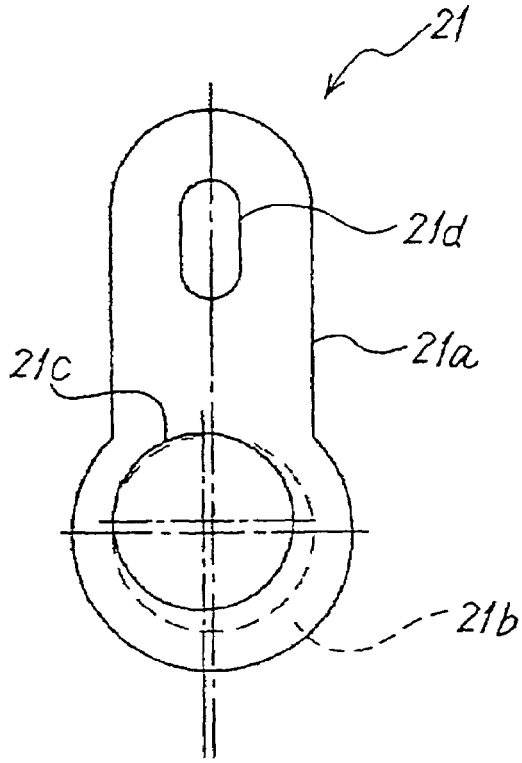
FIGS. 11A and 11B are schematic explanatory diagrams of a horizontal portion cam member.
Figure 11B:
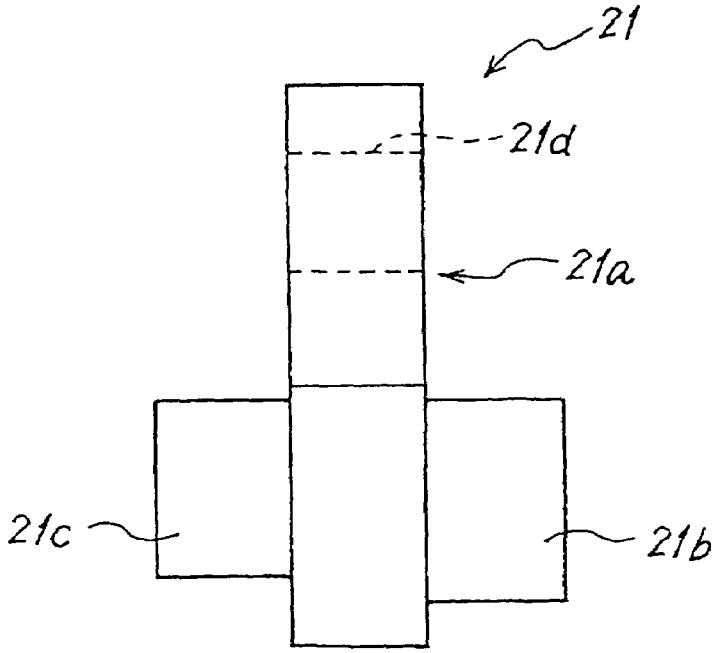

FIGS. 11A and 11B are schematic explanatory diagrams of the horizontal portion cam member 21, FIG. 11A being a front-view diagram and FIG. 11B a rear-view diagram.

The horizontal portion cam member 21 comprises a horizontal first cylindrical section 21*b* engaging with a circular hole provided on the front plate 1 of the structure 200, a horizontal second cylindrical section 21*c* engaging with a substantially circular hole provided in the front fixing guide plate 4, and a horizontal tab 21*a*. A horizontal cam fixing screw hole 21*d* is provided also in the horizontal tab 21*a*. As illustrated in FIGS. 11A and 11B, the horizontal portion cam member 21 is a cam member in which the center axes of the horizontal first cylindrical section 21*b* and the horizontal second cylindrical section 21*c* do not coincide.

Similarly to the horizontal portion cam member 21, the upper portion cam member 20 comprises an upper tab 20*a*, an upper first cylindrical section 20*b*, an upper second cylindrical section 20*c*, and an upper cam fixing screw hole 20*d*.

Figure 12:
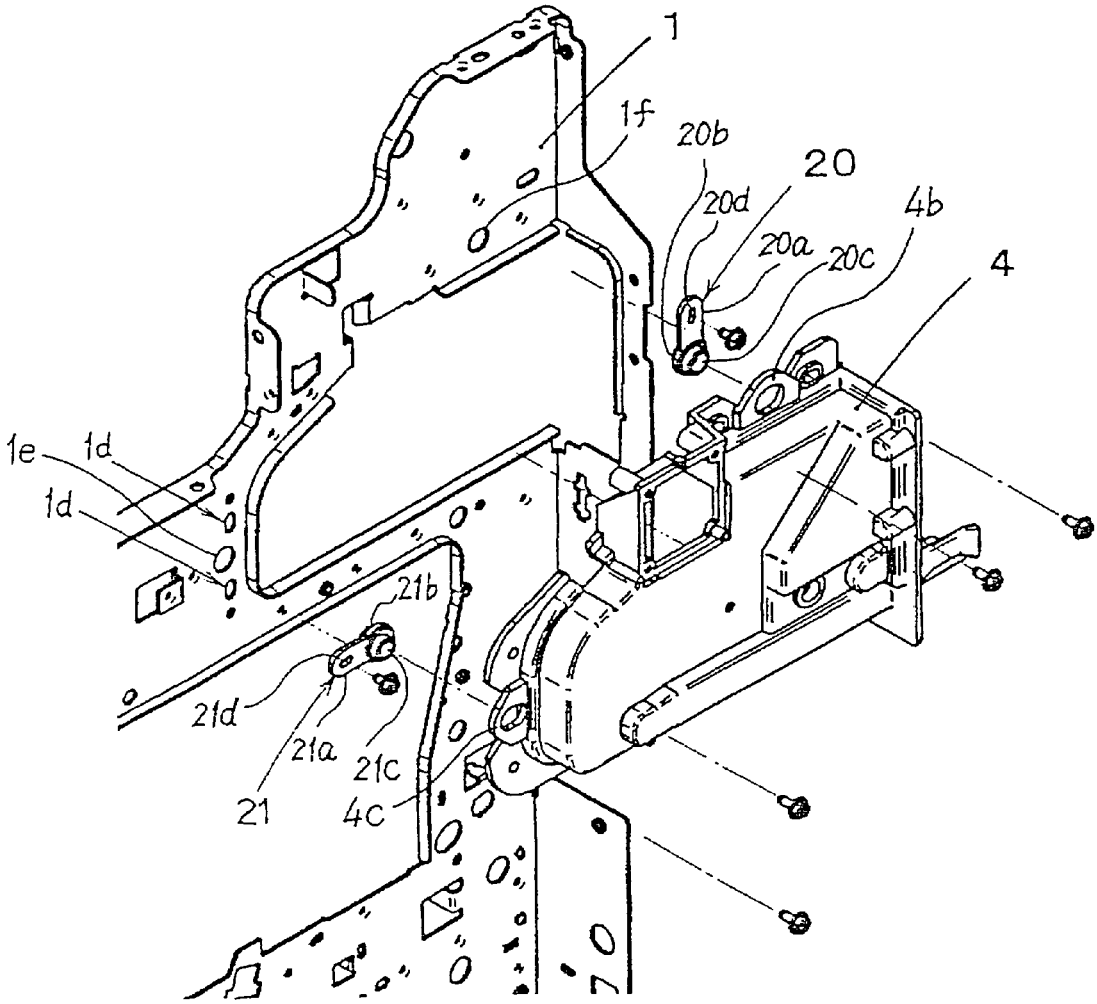
FIG. 12 is an exploded view illustrating mounting locations of a front fixing guide plate, and of the cam member on the front plate of the structure.

FIG. 12 is an exploded view illustrating the mounting locations of the front fixing guide plate 4, the horizontal portion cam member 21 and the upper portion cam member 20 on the front plate 1 of the structure 200.

As illustrated in FIG. 12, the horizontal portion cam member 21 is flanked by the front plate 1 and the front fixing guide plate 4, the horizontal first cylindrical section 21*b* engages with a side plate horizontal portion circular hole 1*e* provided in the front plate 1, while the horizontal second cylindrical section 21*c* engages with a quasi-circular horizontally elongated side portion circular hole 4*c* provided in the front fixing guide plate 4. Similarly, the upper portion cam member 20 is flanked by the front plate 1 and the front fixing guide plate 4, the upper first cylindrical section 20*b* engages with a side plate upper portion circular hole if provided in the front plate 1, while the upper second cylindrical section 20*c* engages with a quasi-circular horizontally elongated upper portion circular hole 4*b* provided in the front fixing guide plate 4. On the front fixing guide plate 4 are also provided screw holes flanking respectively the side portion circular hole 4*c* and the upper portion circular hole 4*b*, such that the front fixing guide plate 4 can be fixed to the front plate 1 through screw fastening in these screw holes.

Figure 13:
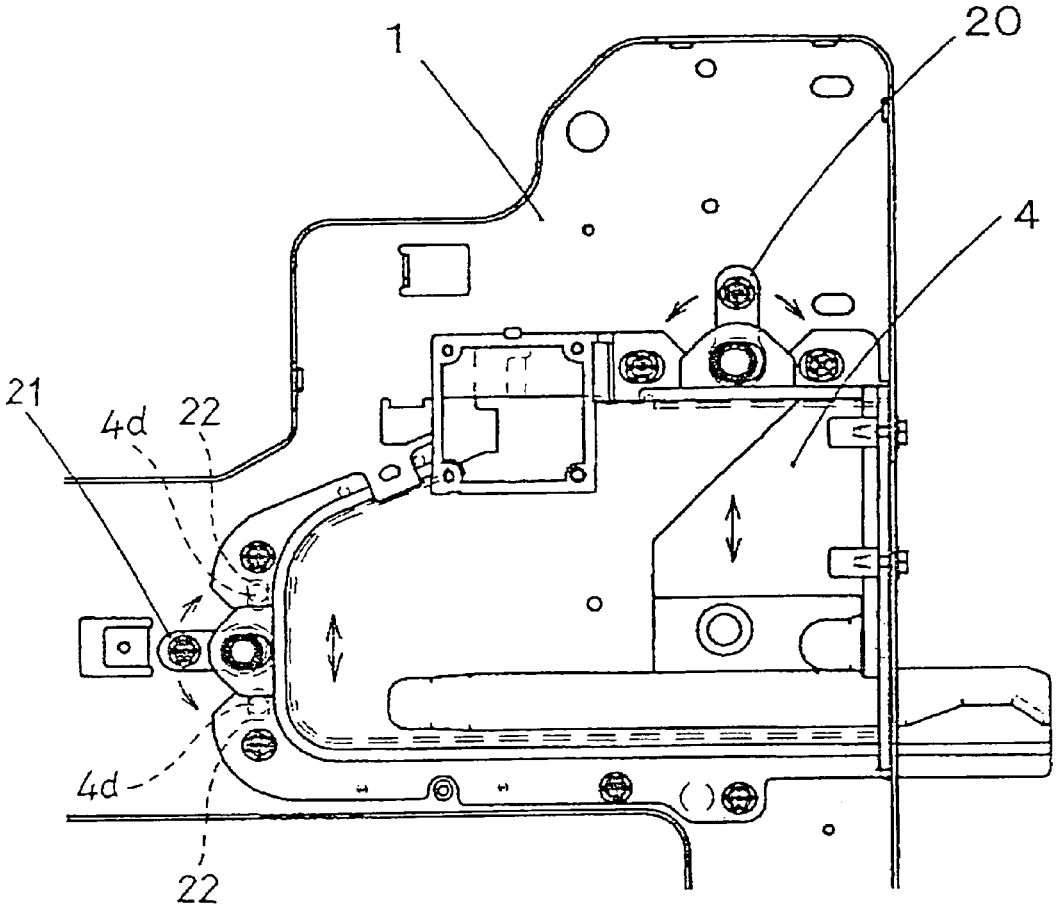
FIG. 13 is an explanatory diagram illustrating the directions in which the cam member and the front fixing guide plate can move.

FIG. 13 illustrates the directions in which the horizontal portion cam member 21 and the upper portion cam member 20 can move, and the directions in which the front fixing guide plate 4 can move.

As illustrated in FIG. 13, the position of the front fixing guide plate 4 in the vertical direction can be adjusted through pivoting of the upper portion cam member 20 and the horizontal portion cam member 21 around the horizontal first cylindrical section 21*b* of the horizontal portion cam member 21 and the upper first cylindrical section 20*b* of the upper portion cam member 20. A cylindrical positioning protrusion 4*d* is also provided on the rear side of the front fixing guide plate 4, while on the front plate 1 is provided a positioning slotted hole id elongated in the height direction and having the same width as that of the positioning protrusion 4*d*, in the horizontal direction, such that the movement of the front fixing guide plate 4 in the horizontal direction is restricted through insertion of the positioning protrusion 4*d* into the positioning slotted hole 1*d*. The movement of the front fixing guide plate 4 in the horizontal direction is thus restricted even when the upper second cylindrical section 20*c* and the horizontal second cylindrical section 21*c* rotate around the upper first cylindrical section 20*b* and the horizontal first cylindrical section 21*b* through pivoting of the horizontal portion cam member 21 and the upper portion cam member 20.

The shapes of the upper portion circular hole 4*b* and the side portion circular hole 4*c* of the front fixing guide plate 4 are slightly elongated in the horizontal direction, to allow absorbing the positional offset in the horizontal direction of the upper second cylindrical section 20*c* and the horizontal second cylindrical section 21*c* relative to the front fixing guide plate 4.

Figure 14A:
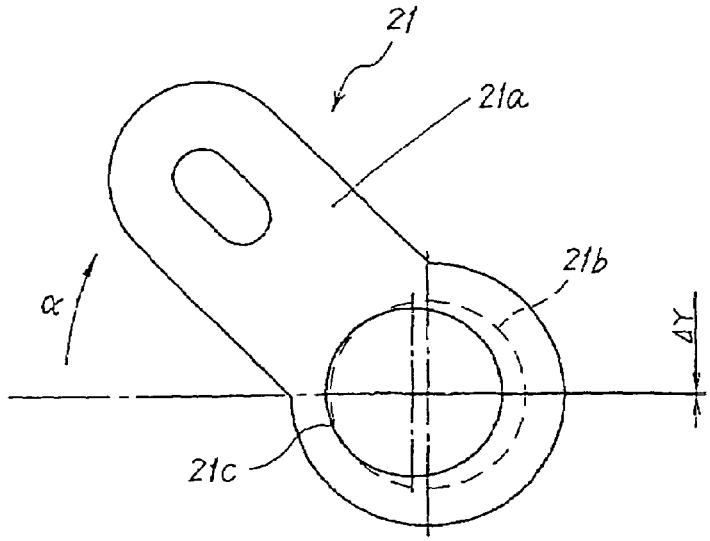
FIGS. 14A to 14C are explanatory diagrams illustrating the amount of vertical direction adjustment through angle displacement of the cam member.
Figure 14B:
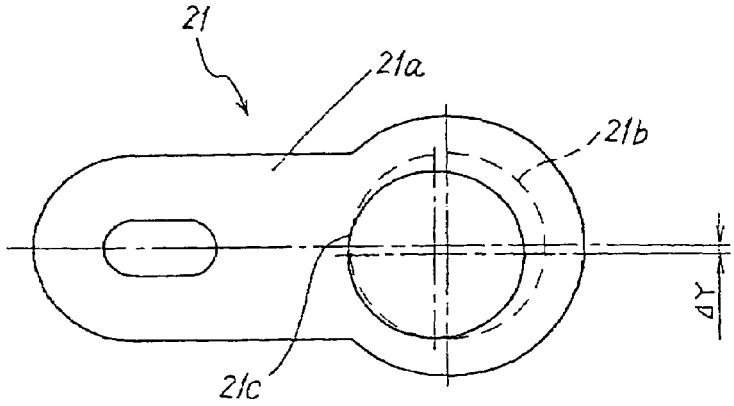
Figure 14C:
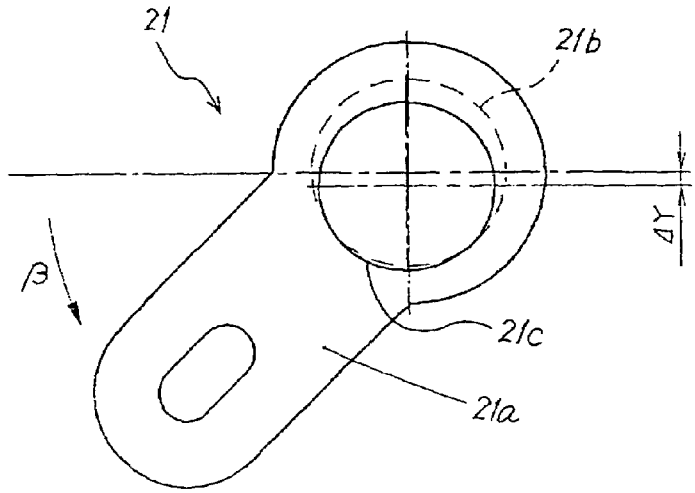

FIGS. 14A through 14C are an explanatory diagrams illustrating the adjustment in the vertical direction through angle displacement of the horizontal portion cam member 21.

During shipping, the horizontal portion cam member 21 is in the state illustrated in FIG. 14B, with the front fixing guide plate 4 fixed to the side plate 1. At this time, the center axis of the horizontal second cylindrical section 21*c* is at a lower position that the center axis of the horizontal first cylindrical section 21*b*. Herein, $\Delta Y$ stands for the height difference of the center axes of the horizontal second cylindrical section 21*c* and the horizontal first cylindrical section 21*b*.

As illustrated in FIG. 14A, when the horizontal tab 21*a* is rotated in the direction of arrow $\alpha$, the height difference of the center axes of the horizontal second cylindrical section 21*c* and the horizontal first cylindrical section 21*b*, i.e. $\Delta Y$, becomes smaller than in the situation of FIG. 14B. The height of the horizontal second cylindrical section 21*c* relative to the horizontal first cylindrical section 21*b* becomes thereby higher than in the situation of FIG. 14B, thus increasing the height of the front fixing guide plate 4 supported on the horizontal second cylindrical section 21*c* relative to the front plate 1 with which the horizontal first cylindrical section 21*b* engages. The height of the front fixing guide plate 4 relative to the front plate 1 can thus be increased.

As illustrated in FIG. 14C, when the horizontal tab 21*a* is rotated in the direction of arrow $\beta$, the height difference of the center axes of the horizontal second cylindrical section 21*c* and the horizontal first cylindrical section 21*b*, i.e. $\Delta Y$, becomes greater than in the situation of FIG. 14B. The height of the horizontal second cylindrical section 21*c* relative to the horizontal first cylindrical section 21*b* becomes thereby lower than in the situation of FIG. 14B, thus reducing the height of the front fixing guide plate 4 supported in the horizontal second cylindrical section 21*c* relative to the front plate 1 with which the horizontal first cylindrical section 21*b* engages. The height of the front fixing guide plate 4 relative to the front plate 1 can thus be reduced.

The upper portion cam member 20 works in the same way as the horizontal portion cam member 21 explained in FIGS. 14A through 14C.

As illustrated in FIGS. 14A through 14C, the front fixing guide plate 4 can be moved up an down through shifts in the pivoting angle of the pivot able cam members, which allows performing fine adjustments easily not only during manufacture but also on the site where the device is installed.

Furthermore, the horizontal portion cam member 21 is provided in the vicinity of the front guide primary reference 14 for positioning of the front fixing primary reference 10 of the fixing unit 9, while the upper portion cam member 20 is provided in the vicinity of the front guide subordinate reference 15 for positioning of the front fixing subordinate reference 11 of the fixing unit 9. The pivoting angles of the horizontal portion cam member 21 and the upper portion cam member 20 can be shifted separately, which enables separate fine adjustment of the front fixing primary reference 10 and the front fixing subordinate reference 11 of the fixing unit 9. That is, the angle of the front fixing guide rail 18 can be finely adjusted. Such fine adjustment of the angle of the front fixing guide rail 18 allows correcting torsion of the fixing unit 9 caused by parallelism offset between the front fixing guide rail 18 and the rear fixing guide rail 19 arising from component tolerances and/or assembly errors.

In the copying machine 100, the unit support member is the front fixing guide plate 4 and the rear fixing guide plate 5 paired up and supporting respectively both end portions of the fixing roller 9*a*, as the surface mobile body, in the axial direction. The position of the fixing unit 9 is adjusted through adjustment of the position of the unit support member that supports both ends of the surface mobile body in the axial direction. This allows easily adjusting parallelism offset between the fixing roller 9*a* and the registration roller 41.

The rear fixing guide plate 5, moreover, is fixed relative to the rear plate 2 of the structure 200, while the front fixing guide plate 4 can move relative to the front plate 1 of the structure 200. On the side of the rear plate 2 there are provided gears for transmitting drive to the fixing roller 9*a*, the pressure roller 9*d* and so on, and hence a shift in the position of the rear fixing guide plate 5 positioned relative to the rear plate 2 can result in gear meshing offset. In the copying machine 100 the rear fixing guide plate 5 is fixed, and parallelism is adjusted through displacement of the front fixing guide plate 4, which allows adjusting the parallelism of the fixing roller 9*a* and the registration roller 41 with no gear meshing offset occurring in the fixing unit 9.

Next is explained the unit position adjustment method for adjusting a fixed position of the fixing unit 9, as the surface mobile body unit, relative to the copying machine 100, as the image forming device.

The problems below occur in the copying machine 100 when parallelism cannot be maintained between the registration roller 41, which is one of the paper transport rollers transporting the recording paper from the paper feed device, and the fixing roller 9*a* inside the fixing unit 9, which is the fixing device. Specifically, when parallelism cannot be maintained between the registration roller 41 and the fixing roller 9*a*, the transport direction of the recording paper P by the registration roller 41 becomes offset relative to transport direction of the recording paper P in the fixing nip formed by the fixing roller 9*a* and the pressure roller 9*d*. A sum of forces in the axial direction occurs then on the recording paper P as a result of such transport direction discrepancy, which can give rise to paper skew.

In case of parallelism offset when the distance from the fixing roller 9*a* to the registration roller 41 is larger in the near side than in the far side, the image formed in the recording paper P becomes longer in the near side than in the far side, giving rise to a so-called trapezoidal image. Trapezoidal image is a problem that occurs when the recording paper P transported from the registration roller 41 enters the fixing nip before having passed completely through the secondary transfer nip. This is thought to be the result of linear speed differences between the far side and the near side of the recording paper P, brought about by strain in the long side of the distance between the fixing roller 9*a* and the registration roller 41. Specifically, when the distance between the fixing roller 9*a* and the registration roller 41 is longer in the near side than in the far side, the linear speed of the paper P is greater in the near side than in the far side, which stretches the transferred image in the near side giving rise to a trapezoidal image.

Thus, the upper portion cam member 20 and the horizontal portion cam member 21 are adjusted while viewing the output images. A trapezoidal image being formed with a longer near side in the output image may result from the distance between the fixing roller 9*a* and the registration roller 41 being longer in the near side than in the far side, which gives rise to parallelism offset. In such a case, the upper portion cam member 20 and the horizontal portion cam member 21 are adjusted by loosening the plural screws that fix the position of the front fixing guide plate 4 relative to the front plate 1, so as to lower the front fixing guide plate 4 relative to the front plate 1. After this adjustment, the two cam members are fixed to the front plate 1 with the upper cam fixing screw hole 20*d* and the horizontal cam fixing screw hole 21*d*, and then the plural screws that fix the position of the front fixing guide plate 4 relative to the front plate 1 of the structure 200 are tightened.

On the other hand, a trapezoidal image being formed with a longer far side in the output image may result from the distance between the fixing roller 9*a* and the registration roller 41 being longer in the far side than in the near side, which gives rise to parallelism offset. In such a case, the upper portion cam member 20 and the horizontal portion cam member 21 are adjusted so as to raise the position of the front fixing guide plate 4 relative to the front plate 1 of the structure 200. The parallelism between the fixing roller 9*a* and the registration roller 41 can thus be maintained with a high precision, and hence high-quality image formation can be achieved through fine adjustment of the front fixing guide plate 4, using cam members, in accordance with the output image.

Moreover, the upper portion cam member 20 and the horizontal portion cam member 21 are adjusted with the fixing unit 9 already set, which allows adjusting easily the alignment of the fixing roller 9*a* and the registration roller 41.

The upper portion cam member 20 and the horizontal portion cam member 21 are easily replaceable components. Thus, the adjustment range of the position of the front fixing guide plate 4 relative to the front plate 1 of the structure 200 can be easily modified through pivoting of a combination of assorted plural cam members having differing eccentricities. Specifically, when the adjustment of the horizontal portion cam member 21 illustrated in FIG. 14A through 14C is insufficient, the cam member is replaced by a horizontal portion cam member 21, such as the one illustrated in FIG. 15A through 15C, having a greater eccentricity.

Figure 15A:
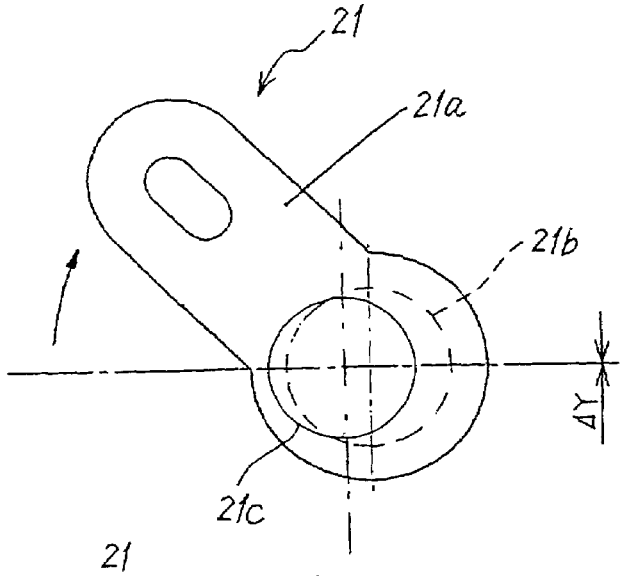
FIGS. 15A to 15C are explanatory diagrams illustrating the amount of vertical direction adjustment through angle displacement of a cam member having a larger eccentricity.
Figure 15B:
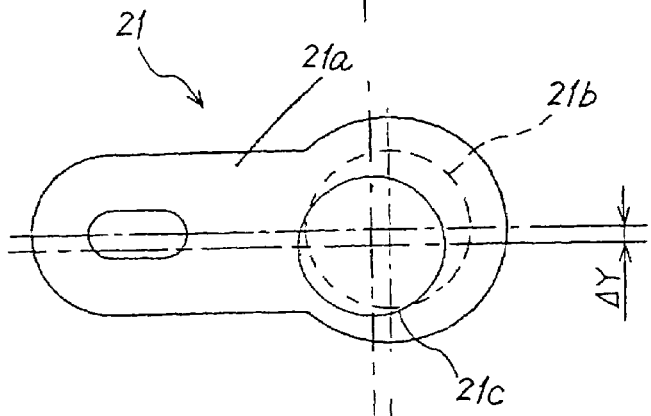
Figure 15C:
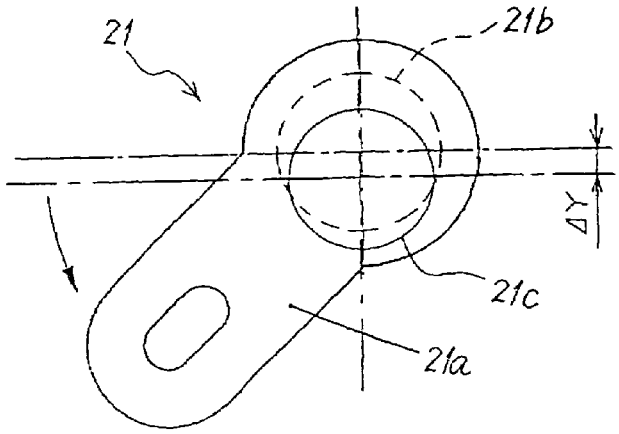

As illustrated in FIGS. 15A through 15C, the amplitude of $\Delta Y$, i.e. the height difference between the center axes of the horizontal second cylindrical section 21*c* and the horizontal first cylindrical section 21*b*, upon pivoting of the horizontal portion cam member 21 can be increased through augmented eccentricity, by increasing the distance between the horizontal second cylindrical section 21*c* and the center axis of the horizontal first cylindrical section 21*b*.

Parallelism can thus be ensured, even in case of large parallelism offset between the registration roller 41 and the fixing roller 9*a* during shipping, through replacement of a cam member by a more eccentric one.

The cam members may be provided with arrow marks, and the front plate 1 that is the device main body side may be provided with a scale.

Figure 16:
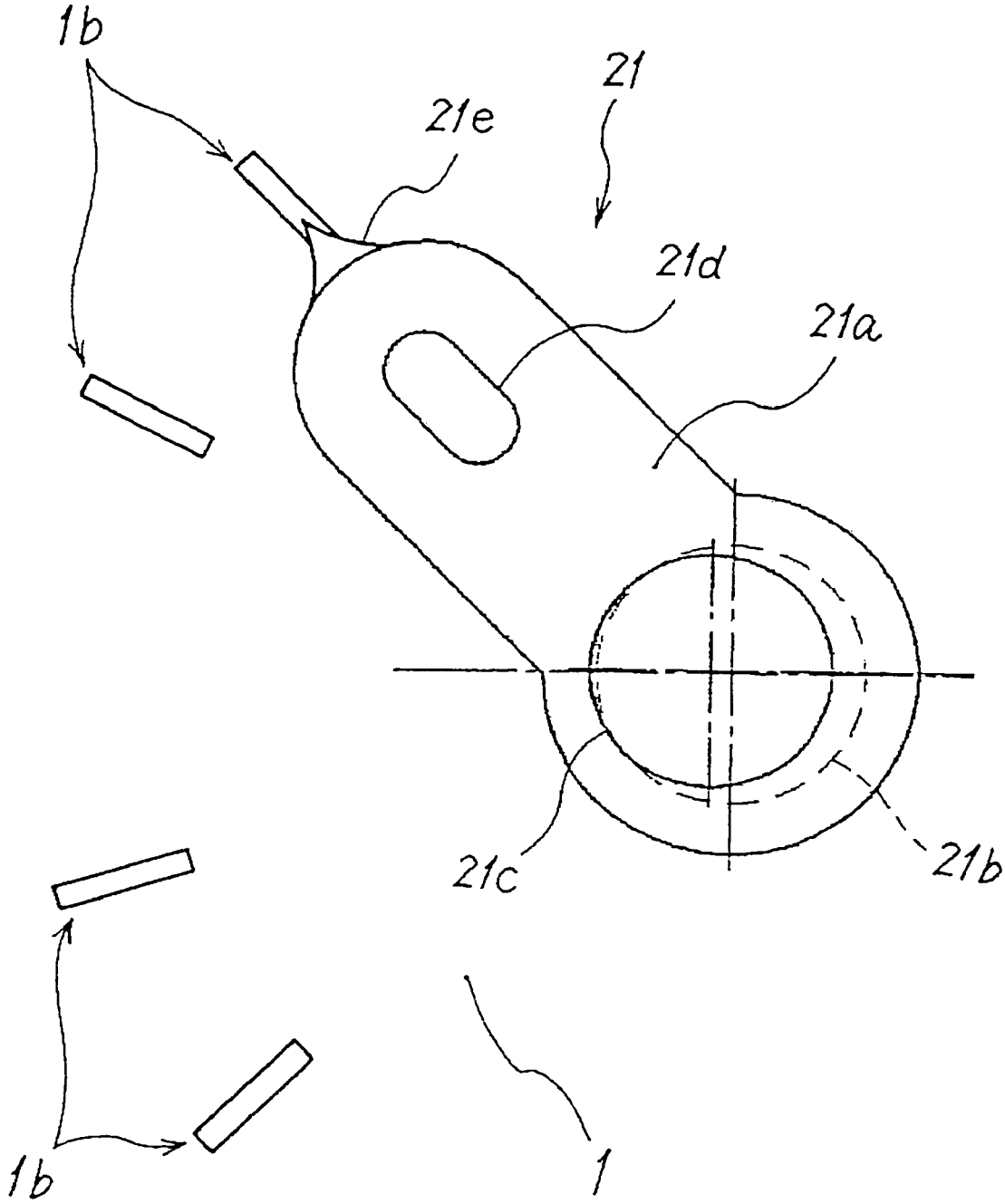
FIG. 16 is an explanatory diagram of a constitution wherein an arrow mark is provided in the cam member and a scale is provided in the device main body side.

FIG. 16 is an explanatory diagram of a constitution wherein an arrow mark 21*e* is provided in the horizontal portion cam member 21 and four scales 1*b* are provided in the front plate 1 that is the device main body side. As illustrated in FIG. 16, the amount of adjustment can be accurately grasped, during adjustment using the horizontal portion cam member 21, by means of the arrow mark 21*e* and the scales 1*b*. In the example illustrated in FIG. 16, the arrow mark 21*e* has a vertical displacement range of 45°, and there are provided four scales 1*b*, but neither the displacement range of the arrow mark 21*e* nor the number of scales 1*b* are limited to these values.

A cam member click mechanism can also be provided.

Figure 17A:
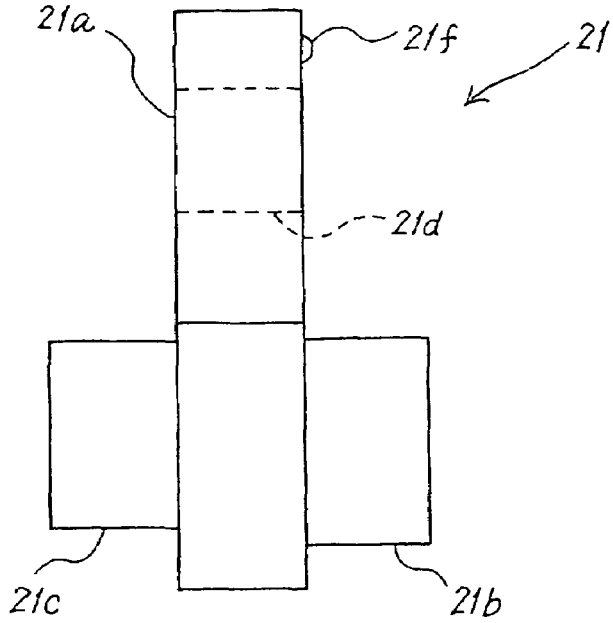
FIG. 17A is a schematic side-view diagram of a cam member using a click mechanism.
Figure 17B:
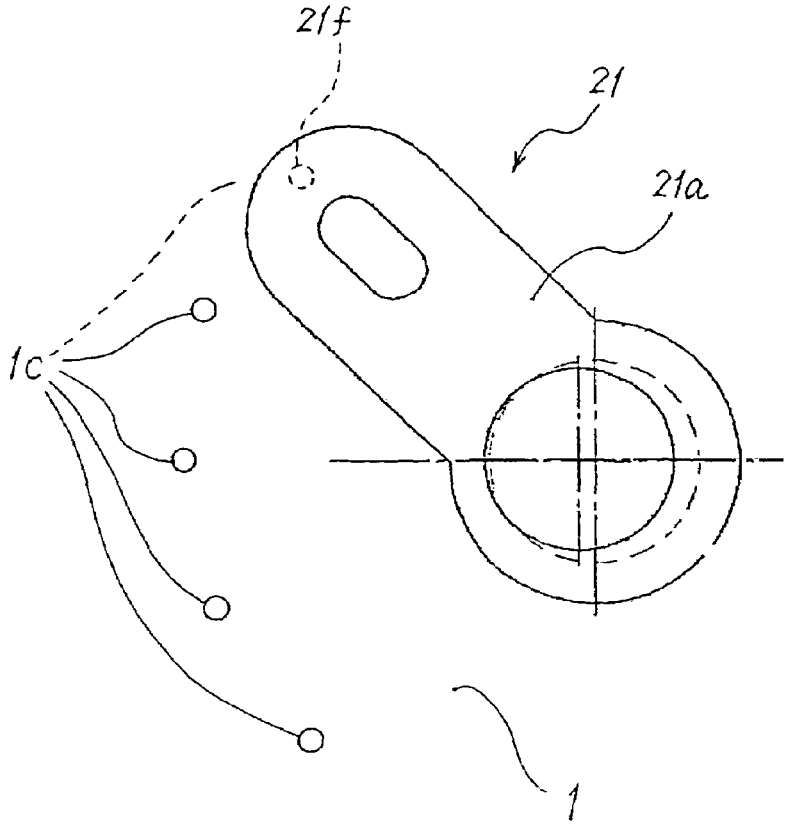
FIG. 17B is an explanatory diagram of the cam member, using a click mechanism, in a mounted state.

FIGS. 17A and 17B is an explanatory diagram of the constitution of a click mechanism provided in the horizontal portion cam member 21. FIG. 17A is a schematic side-view diagram of the horizontal portion cam member 21 using a click mechanism. FIG. 17B is an explanatory diagram of the horizontal portion cam member 21, using a click mechanism, in a mounted state. As illustrated in FIG. 17A, a semispherical click protrusion 21*f* is provided in the vicinity of the front end of the horizontal portion cam member 21. As illustrated in FIG. 17B, five click depressions 1*c* are provided along the trajectory of the click protrusion 21*f* upon rotation of the horizontal portion cam member 21 of the front plate 1.

Thanks to the click protrusion 21*f* and the click depressions 1*c*, the click protrusion 21*f* hooks into the click depressions 1*c* as the horizontal portion cam member 21 rotates, thereby facilitating the adjustment of the horizontal portion cam member 21 to a predetermined position.

FIG. 17B shows the click protrusion 21*f* when engaged with the uppermost of the click depressions 1*c*.

The cam members may also be provided with a recess, so that pivoting of the cam members can be adjusted using a screwdriver or the like.

Figure 18:
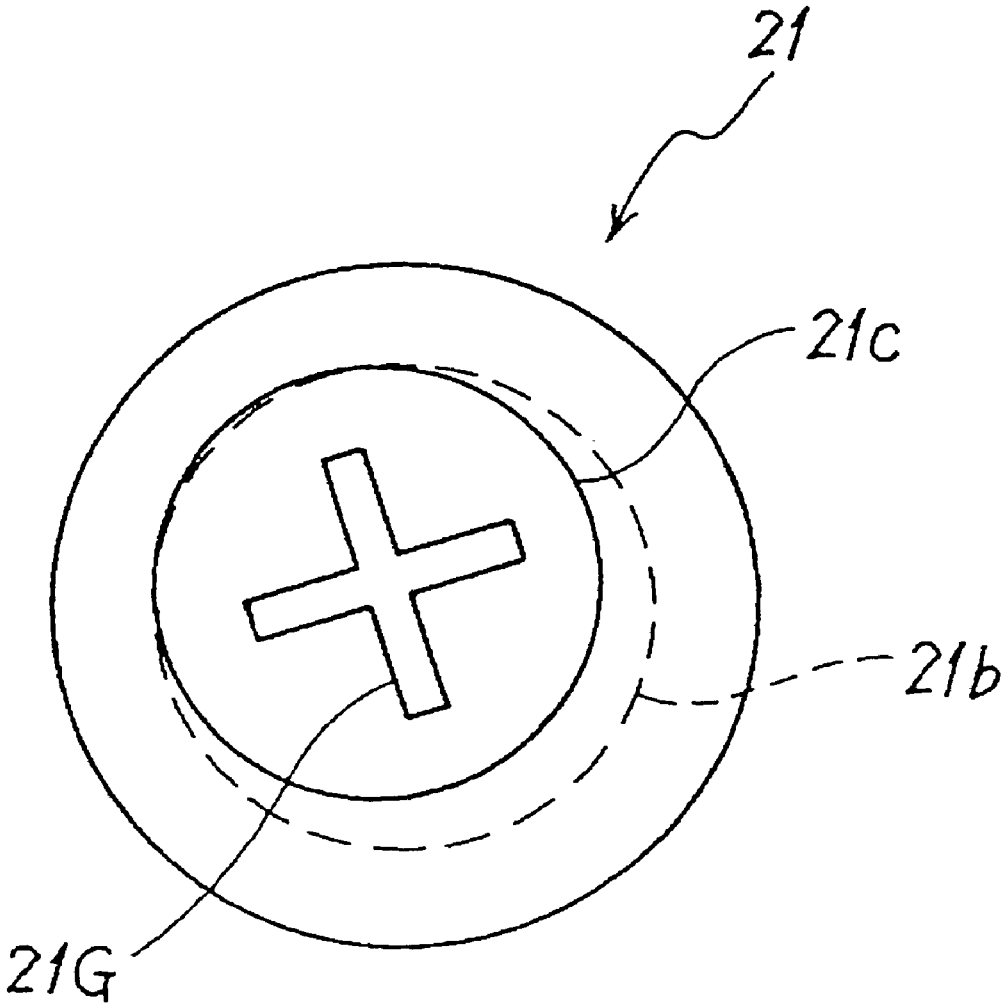
FIG. 18 is a diagram illustrating the cam member provided with a recess.

FIG. 18 illustrates a constitution wherein the horizontal portion cam member 21 is provided with a recess 21*g*. Thanks to the recess, the pivoting amplitude of the horizontal portion cam member 21 can be adjusted using a tool such as a screwdriver or the like, thereby rendering unnecessary a tab portion and affording a smaller horizontal portion cam member 21.

When the cam members are provided with a recess, adjustment can be performed by means of a screwdriver inserted through holes opened in the exterior cladding opposite the cam members.

Although the recess illustrated in FIG. 18 is a recess corresponding to a cross-head screwdriver, the recess is not limited to this shape, and may be formed with a shape corresponding to a slotted screwdriver or a tool with some other shape.

Figure 19:
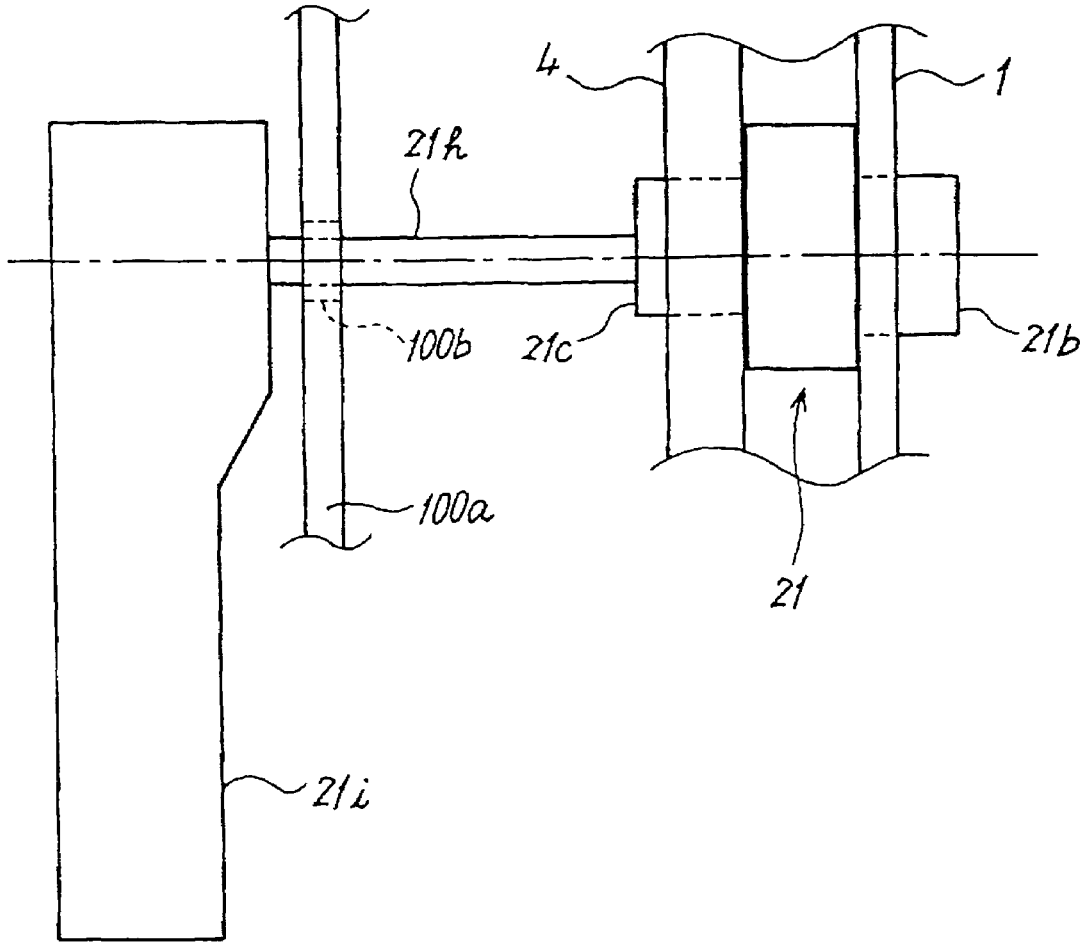
FIG. 19 is a diagram illustrating the cam member provided with a lever.

Adjustment from outside is not limited to the above constitution in which adjustment is performed with a screwdriver passing through a hole opened in the external cladding; external adjustment may also be performed herein through a rotating shaft of a cam member. FIG. 19 illustrates one such example.

FIG. 19 is a schematic explanatory diagram of the constitution of a lever provided in a cam member.

As illustrated in FIG. 19, a rotation transmission shaft 21*h*, coaxial with the horizontal first cylindrical section 21*b*, is provided latching with the front plate 1, the rotation transmission shaft 21*h* passing through an exterior cladding hole 100*b* provided in an external cladding 100*a*, and with a cam operating lever 21*i* provided on the outer side of the external cladding 100*a*. Pivoting of the cam member can be thus easily adjusted by thrusting the rotation transmission shaft 21*h* out of the external cladding 100*a* and providing the cam operating lever 21*i*, whereby not only a service engineer but also the user can adjust the parallelism between the fixing roller 9*a* and the registration roller 41. When the cam member is adjusted from the external cladding having holes opened thereon, the external cladding may also be provided with a scale. Such a scale assists the user during parallelism adjustment.

The constitutions illustrated in FIGS. 15A through 19 were based on the horizontal portion cam member 21, but they would be identical for the upper portion cam member 20.

According to Embodiment 1 , there are provided the front fixing guide plate 4 as a unit support member, for fixing to the structure 200 the fixing unit 9 being a surface mobile body unit comprising the fixing roller 9*a* being a surface mobile body, and the upper portion cam member 20 and the horizontal portion cam member 21 as unit position adjustment members for adjusting the position of the front fixing guide plate 4 relative to the structure 200. Accordingly, alignment (parallelism) can be easily maintained with a high precision between the fixing roller 9*a* and the registration roller 41 fixed to the structure 200 separately from the fixing unit 9, by adjusting the upper portion cam member 20 and the horizontal portion cam member 21. The transport direction of the recording paper P at the registration roller 41 and the transport direction of the recording paper P at the fixing nip coincide thus as a result, preventing thereby problems derived from transport direction offset, such as trapezoidal image and the like, and affording high-quality image formation.

The unit support member is the front fixing guide plate 4 and rear fixing guide plate 5 paired up, the rear fixing guide plate 5 being fixed relative to the rear plate 2 of the structure 200, the front fixing guide plate 4 being mobile relative to the front plate 1 of the structure 200. Parallelism of the fixing roller 9*a* relative to the registration roller 41 can thus be adjusted by adjusting the position of the front fixing guide plate 4.

The driving forces of the fixing roller 9*a* and the pressure roller 9*d* in the fixing unit 9 are input to the fixing unit 9 from the sides of the rear plate 2 of the copying machine 100 main body and of the rear fixing guide plate 5. Since the driving forces are input from the side of the rear fixing guide plate 5, having a fixed position relative to the structure 200, no gear meshing offset occurs when the position of the front fixing guide plate 4 is shifted relative to the structure 200 in order to adjust parallelism between the fixing roller 9*a* and the registration roller 41.

The horizontal portion cam member 21, as the unit position adjustment member, comprises the horizontal first cylindrical section 21*b* engaging with a circular hole provided in the front plate 1 of the structure 200, the horizontal second cylindrical section 21*c* engaging with a substantially circular hole provided in the front fixing guide plate 4, and the horizontal tab 21*a*. Similarly, the upper portion cam member 20 comprises the upper tab 20*a*, the upper first cylindrical section 20*b*, the upper second cylindrical section 20*c*, and the upper cam fixing screw hole 20*d*. Through the use of such cam members, the fixing guide plates can be moved up an down through shifts in the pivoting angle of the pivot able cam members, which allows performing fine adjustments easily not only during manufacture but also on the site where the device is installed.

The positioning protrusion 4*d* is provided in the front fixing guide plate 4, on the side of the front plate 1 of the structure 200, the positioning slotted hole 1*d*, with which the positioning protrusion 4*d* engages, is provided on the front plate 1, such that the width of the positioning slotted hole 1*d* matches the width of the positioning protrusion 4*d* in the width direction, while in the longitudinal direction the positioning slotted hole 1*d* is wider than the positioning protrusion 4*d*. The movement of the front fixing guide plate 4 in the horizontal direction is restricted thus even when the upper second cylindrical section 20*c* and the horizontal second cylindrical section 21*c* rotate around the upper first cylindrical section 20*b* and the horizontal first cylindrical section 21*b* through pivoting of the horizontal portion cam member 21 and the upper portion cam member 20.

Thanks to the recesses provided in the horizontal portion cam member 21 and the upper portion cam member 20, moreover, the pivoting amplitude of the horizontal portion cam member 21 and the upper portion cam member 20 can be adjusted using a tool such as a screwdriver or the like, thereby rendering unnecessary the tab portions and affording smaller horizontal portion cam members.

Pivoting of the cam members can also be easily adjusted through the levers provided in the horizontal portion cam member 21 and the upper portion cam member 20, whereby not only a service engineer but also the user can adjust the parallelism between the fixing roller 9*a* and the registration roller 41.

Also, the amount of adjustment can be accurately grasped, during adjustment using the cam members, by means of the arrow marks provided in the horizontal portion cam member 21 and the upper portion cam member 20 and the scales provided in the front plate 1.

The click protrusions of the click mechanisms provided in the horizontal portion cam member 21 and the upper portion cam member 20, moreover, hook into the click depressions of the click mechanisms as the cam members rotate, thereby facilitating the adjustment of the cam members to a predetermined position.

Embodiment 2

In Embodiment 1 was explained an instance in which a fixing unit is the surface mobile body unit supported by the unit supporting member that is adjusted by the unit position adjustment members. In Embodiment 2 is described an instance in which the mobile body unit is a photosensitive body unit comprising a photosensitive body as the mobile body.

Figure 20:
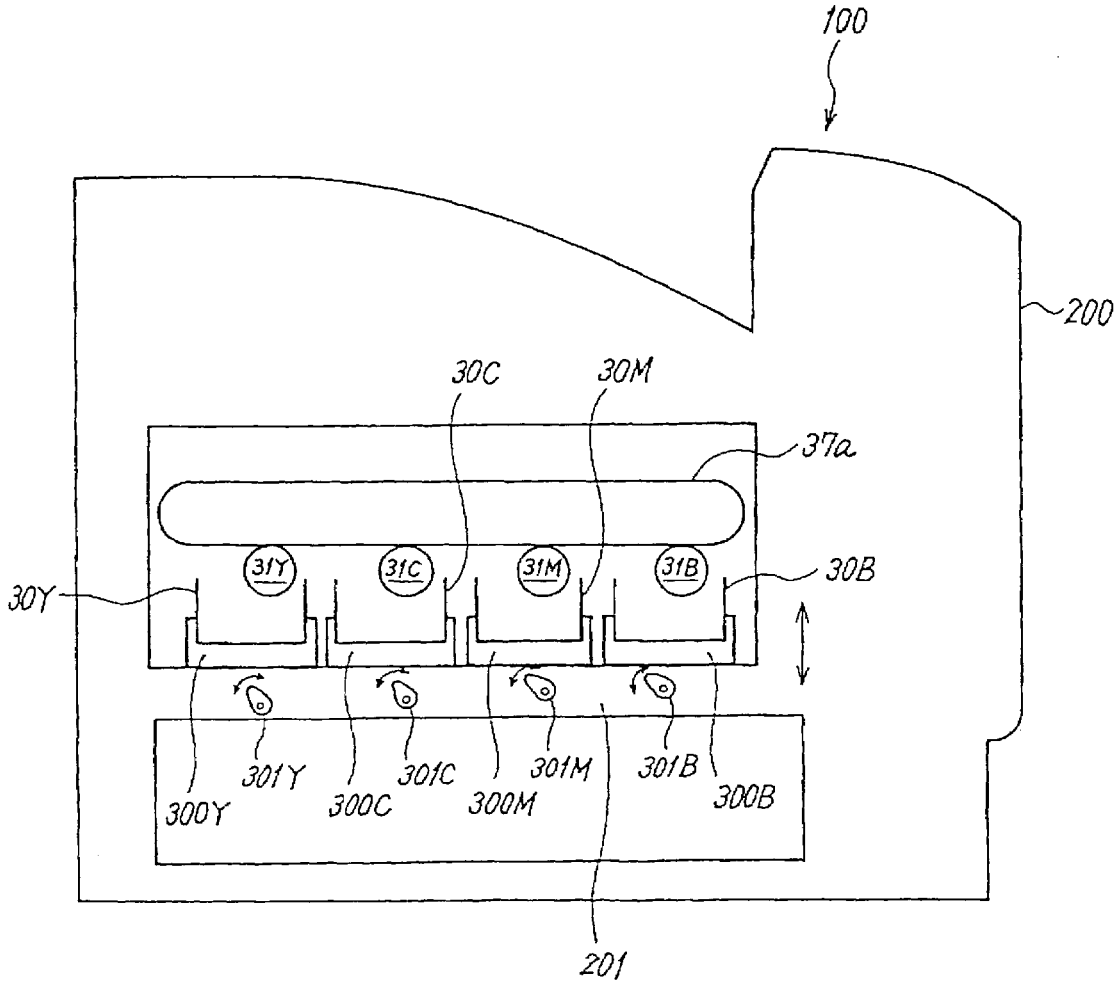
FIG. 20 is a diagram illustrating schematically the constitution of a copying machine according to Embodiment 2 of the present invention.

FIG. 20 is a schematic explanatory diagram of the copying machine 100 comprising image forming section support members 300Y, 300C, 300M, 300B below the image forming units 30Y, 30C, 30M, 30B, for fixing the position of the latter, as the photosensitive body unit, relative to the structure 200.

Except for the unit support members supporting herein the image forming units 30Y, 30C, 30M, 30B as the photosensitive body unit, Embodiment 2 is identical to Embodiment 1 , and hence the constitutions common to Embodiment 1 will not be explained again.

Since the image forming units 30Y, 30C, 30M, 30B are all identically constituted, except for the color of the toner, herein will be described the image forming unit 30Y that uses a yellow toner.

As illustrated in FIG. 20, below the image forming unit 30Y is arranged an image forming section support member 300Y as the unit support member for fixing the position of the image forming unit 30Y relative to an image forming section support frame 201 of the structure 200. In the image forming section support frame 201 is provided, as the unit position adjustment member, an image forming section cam member 301Y for adjusting through pivoting thereof the position of the image forming section support member 300Y relative to the image forming section support frame 201. Pivoting of the image forming section cam member 301Y results herein in the vertical displacement of only the end portion of the image forming section support member 300Y on the side of the front plate 1, on the near side of the figure.

If parallelism cannot be maintained between the rotating shaft of the photosensitive body 31Y and the rotating shaft (rotating shaft of the support roller) of the intermediate transfer belt 37*a* that is the intermediate transfer body, the distance between the photosensitive body 31Y and the intermediate transfer belt 37*a* varies along the axial direction. In such circumstances, the image transferred to the intermediate transfer belt 37*a* may exhibit density unevenness in the axial direction. This would result in density unevenness of the yellow image in the image transferred by the intermediate transfer belt 37*a* to the recording paper P.

Thus, density unevenness between the near side and the far side occurring only for the yellow image formed on the recording paper P suggests that the parallelism between the photosensitive body 31Y and the rotating axis of the support roller of the intermediate transfer belt 37*a* is offset. In such a case, the image forming section cam member 301Y is adjusted while observing the output image, so as to bring the image forming section support member 300Y to a correct position on the near side of the figure.

The above applies equally to the image forming units 30M, 30C, 30B that use other colors.

According to Embodiment 2, there are provided the image forming section support member 300Y, as the unit support member, for fixing relative to the structure 200 the image forming unit 30Y that is the surface mobile body unit comprising the photosensitive body 31Y being the surface mobile body, and the image forming section cam member 301Y, as the unit position adjustment member for adjusting the position of the image forming section support member 300Y relative to the structure 200.

Accordingly, alignment (parallelism) of the photosensitive body 31Y relative to the intermediate transfer belt 37*a* can be easily maintained, with a high precision, by adjusting the image forming section cam member 301Y. Contact between the photosensitive body 31Y and the intermediate transfer belt 37*a* becomes uniform as a result, which precludes density unevenness of the yellow image along the axial direction, thereby affording high-quality image formation.

The same effect can be achieved in the image forming units 30M, 30C, 30B that use other colors.

Embodiment 3

In Embodiment 1 was explained an instance in which a fixing unit is the surface mobile body unit supported by the unit supporting member that is adjusted by the unit position adjustment members. In Embodiment 3, the surface mobile body unit is the intermediate transfer unit comprising the intermediate transfer belt 37*a* as the surface mobile body.

Figure 21:
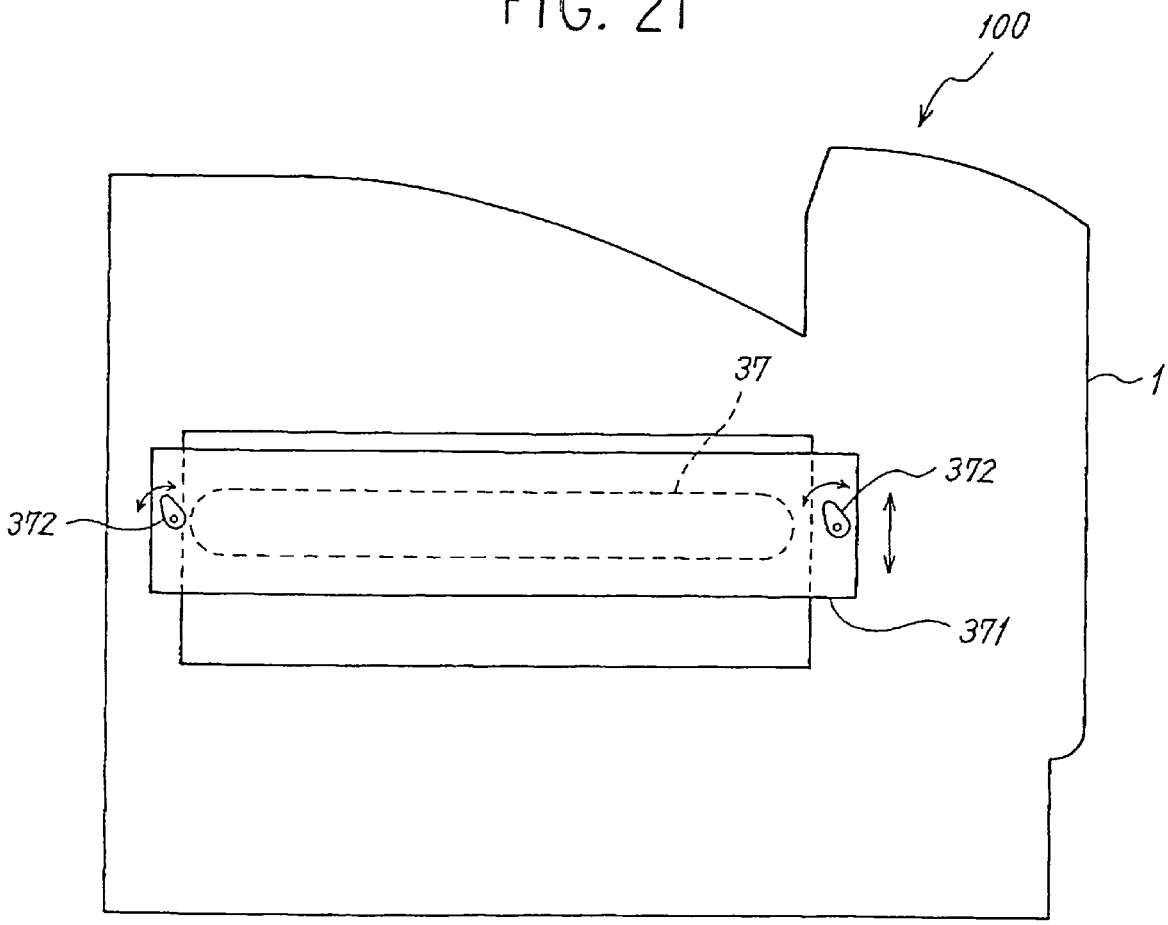
FIG. 21 is a diagram illustrating schematically the constitution of a copying machine according to Embodiment 3 of the present invention.

FIG. 21 is a schematic explanatory diagram of the copying machine 100 comprising an intermediate transfer unit support plate 371 supporting the near-side end portion of the intermediate transfer unit 37.

Except for the intermediate transfer unit support plate 371 supporting herein the near-side end portion of the intermediate transfer unit 37, Embodiment 3 is identical to Embodiment 1, and hence the constitutions common to Embodiment 1 will not be explained again.

As illustrated in FIG. 21, the intermediate transfer unit support plate 371, as the unit support member for fixing the position of the intermediate transfer unit 37 relative to the structure 200, is provided in the intermediate transfer unit 37 on the near side of the image. To the right and left of the intermediate transfer unit support plate 371 are provided transfer device cam members 372 as the unit position adjustment members, for adjusting through pivoting thereof the position of the intermediate transfer unit support plate 371 relative to the structure 200. Pivoting of the transfer device cam members 372 results herein in the vertical displacement of only the end portion of the intermediate transfer unit 37 on the side of the front plate 1, on the near side of the figure.

If parallelism cannot be maintained between the rotating shaft of the support roller of the intermediate transfer belt 37*a* and the rotating shaft of the registration roller 41 as the paper transport roller, the movement direction of the recording paper P in the secondary transfer nip portion, which is the portion in which the image is transferred to the recording paper P as the recording medium, and the movement direction of the intermediate transfer belt 37*a* may slant relative to each other, which can result in a slanted image being formed in the recording paper P.

A slanted image being formed in the recording paper P suggests thus that the parallelism between the rotating shaft of the support roller of the intermediate transfer belt 37*a* and the rotating shaft of the registration roller 41 as the paper transport roller is offset. In such a case, the transfer device cam members 372 are adjusted while observing the output image, so as to bring the intermediate transfer unit support plate 371 to a correct position on the near side of the figure.

According to Embodiment 3, there are provided the intermediate transfer unit support plate 371, as the unit support member, for fixing relative to the structure 200 the intermediate transfer unit 37 being the surface mobile body unit comprising the intermediate transfer belt 37*a* that is the surface mobile body, and the transfer device cam members 372, as the unit position adjustment members for adjusting the position of the intermediate transfer unit support plate 371 relative to the structure 200. Accordingly, alignment (parallelism) of the intermediate transfer belt 37*a* relative to the registration roller 41 can be easily maintained, with a high precision, by adjusting the transfer device cam members 372. The movement direction of the recording paper P and the movement direction of the toner image on the intermediate transfer belt 37*a* become identical as a result, which prevents the formation of a slanted image caused by movement direction mismatch between the toner image and the recording paper P in the secondary transfer nip, thereby affording high-quality image formation.

In the present invention, thus, the position of the surface mobile body unit relative to the structure can be adjusted once the image forming device is put together, which allows adjusting the positional relationship between the surface mobile bodies comprised in the surface mobile body unit and other surface mobile bodies fixed to the structure. As a result, parallelism among the rotating shafts of the surface mobile bodies can be adjusted with high precision, which has the superior effect of affording high-quality image formation.

Various modifications will become possible for those skilled in the art after receiving the teachings of the present disclosure without departing from the scope thereof.

What is claimed is:

1. An image forming device, comprising:

a structure forming a framework of a device main body;

a surface mobile body unit comprising a surface mobile body for supporting/transporting a toner image, or a plurality of surface mobile bodies for transporting a recording medium, and part of a plurality of surface mobile bodies;

the surface mobile body fixed to the structure separately from the surface mobile body unit;

a unit support member, being a member other than the structure, for supporting the surface mobile body unit and for fixing the position of the surface mobile body unit to the structure; and a unit position adjustment member for adjusting the position of the unit support member relative to the structure.

2. The image forming device as claimed in claim 1, wherein the surface mobile body unit is a fixing unit comprising a roller-like or belt-like fixing member as the surface mobile body.

3. The image forming device as claimed in claim 1, wherein the surface mobile body unit is a photosensitive body unit comprising a drum-like or belt-like photosensitive body as the surface mobile body.

4. The image forming device as claimed in claim 1, wherein the surface mobile body unit is an intermediate transfer unit comprising a roller-like or belt-like intermediate transfer body as the surface mobile body.

5. The image forming device as claimed in claim 1, wherein the unit support member is a guide member for guiding the surface mobile body unit to a predetermined position relative to the structure.

6. The image forming device as claimed in claim 1, wherein two unit support members are provided for one surface mobile body unit, the unit support members supporting respectively two ends of the surface mobile body in the axial direction, such that the position of one of the unit support members relative to the structure can be adjusted independently from the position of the other unit support member relative to the structure.

7. The image forming device as claimed in claim 6, wherein at least one of the unit support members comprises a plurality of the unit position adjustment members, the respective unit position adjustment members being separately adjustable.

8. The image forming device as claimed in claim 6, wherein the unit position adjustment member is provided in only one of the unit support members, the other unit support member being fixed to the structure.

9. The image forming device as claimed in claim 8, wherein power of the surface mobile body is input to the surface mobile body unit from the side where the unit support member is fixed to the structure.

10. The image forming device as claimed in claim 1, wherein a positioning protrusion is provided in the unit support member comprising the unit position adjustment member, on the side of the structure, and a positioning slotted hole, with which the positioning protrusion engages, is provided in the structure, such that in the width direction the widths of the positioning slotted hole and of the positioning protrusion coincide, while in the longitudinal direction the positioning slotted hole is wider than the positioning protrusion.

11. The image forming device as claimed in claim 1, wherein the unit position adjustment member is a cam member comprising a first cylindrical section engaging with a circular hole provided on the structure, and a second cylindrical section engaging with a circular hole or a substantially circular hole provided in the unit support member, such that the center axes of the first cylindrical section and of the second cylindrical section do not coincide.

12. The image forming device as claimed in claim 11, wherein a recess is provided in the cam member.

13. The image forming device as claimed in claim 11, wherein a lever is provided in the cam member.

14. The image forming device as claimed in claim 11, wherein an arrow mark is provided in the cam member and a scale is provided in the device main body.

15. The image forming device as claimed in claim 11, wherein a click mechanism is provided in the cam member.

16. A unit position adjustment method for adjusting, relative to an image forming device main body, a fixed position of a surface mobile body unit comprising a surface mobile body for supporting/transporting a toner image, or a surface mobile body for transporting a recording medium, comprising the step of adjusting, by means of a unit position adjustment member, the position of a unit support member relative to a structure that forms a framework of the image forming device main body, the unit support member being a member other than the structure and fixing the surface mobile body unit to the structure, to adjust thereby the fixed position of the surface mobile body unit relative to the image forming device main body.

17. The unit position adjustment method as claimed in claim 16, wherein the position of the unit support member relative to the structure is adjusted with the surface mobile body unit being supported by the unit support member.

18. The unit position adjustment method as claimed in claim 16, wherein the unit position adjustment member is a cam member, the position of the unit support member relative to the structure being adjusted through pivoting of the cam member.

19. The unit position adjustment method as claimed in claim 18, wherein a plurality of the cam members having different eccentricities are provided, and the adjustment range of the position of the unit support member relative to the structure is modified through interchanging and pivoting of the cam members.

* * * * *